US009248652B2

(12) United States Patent
Watanabe

(10) Patent No.: US 9,248,652 B2
(45) Date of Patent: Feb. 2, 2016

(54) LIQUID EJECTING APPARATUS

(71) Applicant: Seiko Epson Corporation, Shinjuku-ku (JP)

(72) Inventor: Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/632,128

(22) Filed: Feb. 26, 2015

(65) Prior Publication Data

US 2015/0246544 A1 Sep. 3, 2015

(30) Foreign Application Priority Data

Mar. 3, 2014 (JP) ..... 2014-040876

(51) Int. Cl.
*B41J 2/165* (2006.01)
*B41J 2/14* (2006.01)

(52) U.S. Cl.
CPC ..... *B41J 2/16535* (2013.01); *B41J 2/1433* (2013.01)

(58) Field of Classification Search
CPC ..... B41J 2/165; B41J 2/16538
USPC ..... 347/20, 22, 33
See application file for complete search history.

(56) References Cited

U.S. PATENT DOCUMENTS

2003/0234830 A1 12/2003 Sakamoto
2013/0038664 A1 * 2/2013 Kagata et al. ..... 347/44

FOREIGN PATENT DOCUMENTS

JP 2002234149 A * 8/2002
JP 2004-082699 A 3/2004
JP 2010-228151 A 10/2010

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

A liquid ejecting apparatus is provided with a liquid ejecting head that ejects a liquid from nozzle openings and a wiping section that sweeps over a liquid ejecting surface side of the liquid ejecting head, the liquid ejecting head is provided with a nozzle plate that has the liquid ejecting surface and a protective member which has an opening section, and which is provided to protrude further on a side of liquid discharge than the nozzle plate and which exposes the liquid ejecting surface, the wiping section sweeps over the liquid ejecting surface of the nozzle plate by moving toward a sweeping direction, which is an in-plane direction of the liquid ejecting surface, and, in the nozzle plate, a distance in an orthogonal direction, which is orthogonal to the sweeping direction, of a first blank space section from an end of the nozzle plate to an end nozzle opening that is provided on a side of the end is longer than a distance in the sweeping direction of a second blank space section from an end of the nozzle plate to an end nozzle opening that is provided on a side of the end.

8 Claims, 17 Drawing Sheets

LIQUID EJECTING APPARATUS

This application claims priority to Japanese Patent Application No. 2014-040876, filed Mar. 3, 2014, the entirety of which is incorporated by reference herein.

BACKGROUND

1. Technical Field

The present invention relates to a liquid ejecting apparatus that is provided with a liquid ejecting head that ejects a liquid from a nozzle opening, and in particular, to an ink jet type recording apparatus that is provided with an ink jet type recording head that discharges ink as the liquid.

2. Related Art

Among liquid ejecting apparatuses that eject a liquid onto a target recording medium, for example, ink jet type recording apparatuses that perform printing on a target recording medium (ejection target medium) such as paper, a recording sheet or the like by ejecting ink as a liquid are known.

Since the ink jet type recording heads with which these kind of ink jet type recording apparatuses are equipped discharge ink droplets onto the ejection target medium from the nozzle openings, for example, there is a problem in that a discharge direction of the ink droplets is not stable, and a problem in that discharge defects such as ink droplets not being discharged occur as a result of ink becoming attached to the vicinity of the nozzle openings of a liquid ejecting surface that ejects ink droplets, and as a result of attached ink solidifying.

Because of this, a liquid ejecting apparatus that wipes ink, fluff, dust, paper powder and the like that have become attached to the liquid ejecting surface by sweeping over the liquid ejecting surface using a wiper blade that is made from rubber board, has been suggested (for example, refer to JP-A-2010-228151).

In addition, there is a problem in that, even if the liquid ejecting surface is wiped with the wiper blade, ink, fluff, dust, paper powder and the like become attached to the surface of a protective member such as a cover head that is provided on a liquid ejecting surface side, and the target recording medium becomes stained when the target recording medium comes into contact with the protective member.

Because of this, an ink jet recording apparatus in which a concave section is provided between the protective member and the liquid ejecting surface, and which is configured to wipe the surface of the protective member and the liquid ejecting surface with the wiper blade, has been suggested (for example, refer to JP-A-2004-82699).

However, there is a problem in that if the blank space between an end of a nozzle plate and an end nozzle opening that is provided on a side of this end is large, the nozzle plate is increased in size, the ink jet type recording head is increased in size, and therefore the cost is increased.

In addition, if the blank space between an end of the nozzle plate and an end nozzle opening that is provided on a side of this end is small, since there is a difference in level between the protective member and the liquid ejecting surface, there is a problem in that the shape of the wiper blade is not stable, and therefore, there is a concern that sweeping defects will occur in the vicinity of the end nozzle opening.

Additionally, as well as ink jet type recording apparatuses, these kind of problems are also present in the same manner in liquid ejecting apparatuses that eject liquids other than ink.

SUMMARY

An advantage of some aspects of the invention is to provide a liquid ejecting apparatus that can reliably perform wiping of the vicinity of the nozzle openings and achieve a reduction in size.

According to an aspect of the invention, there is provided a liquid ejecting apparatus which is provided with a liquid ejecting head that ejects a liquid from nozzle openings and a wiping section that sweeps over a liquid ejecting surface side of the liquid ejecting head, in which the liquid ejecting head is provided with a nozzle plate that has the liquid ejecting surface, and a protective member which has an opening section, and which is provided to protrude further on a side of liquid discharge than the nozzle plate, and which exposes the liquid ejecting surface, a wiping section that sweeps over the liquid ejecting surface of the nozzle plate by moving toward a sweeping direction, which is an in-plane direction of the liquid ejecting surface, and, in the nozzle plate, a distance in an orthogonal direction, which is orthogonal to the sweeping direction, of a first blank space section from an end of the nozzle plate to an end nozzle opening that is provided on a side of the end is longer than a distance in the sweeping direction of a second blank space section from an end of the nozzle plate to an end nozzle opening that is provided on a side of the end.

In this case, by making the distance of the first blank space section of the nozzle plate longer than the distance of the second blank space section, it is possible to suppress a circumstance in which the vicinity of the end nozzle opening in the orthogonal direction remains unwiped when the wiping section sweeps over the liquid ejecting surface.

In this instance, it is preferable that a protrusion amount of the protective member from the liquid ejecting surface be greater than or equal to 30 μm but less than or equal to 100 μm, an interval in the orthogonal direction between an opening edge section of the protective member and an end of the nozzle plate be greater than or equal to 0.05 mm but less than or equal to 0.3 mm, and a distance of the first blank space section be greater than or equal to 0.8 mm but less than or equal to 3.0 mm. In this case, it is possible to suppress increases in cost due to the size of the nozzle plate being significantly increased. In addition, since the distance of the first blank space section is demarcated, it is possible to reliably reduce a circumstance in which the vicinity of the end nozzle opening in the orthogonal direction remains unwiped.

In addition, it is preferable that a size of the first blank space section is greater than or equal to 1.0 mm but less than or equal to 2.0 mm. In this case, it is possible to further suppress increases in cost due to the size of the nozzle plate being significantly increased. In addition, by defining the distance of the first blank space section, it is possible to reliably reduce a circumstance in which the vicinity of the end nozzle opening in the orthogonal direction remains unwiped.

In addition, it is preferable that the nozzle plate be smaller than an opening area of the opening section of the protective member. In this case, by making the area of the nozzle plate smaller, it is possible to further reduce cost.

In addition, it is preferable that the nozzle plate be formed from a silicon monocrystalline substrate. In this case, in addition to high precision processing at high density being possible, it is possible to suppress a circumstance in which damage is caused to the nozzle plate due to an impact of the wiping section abutting against the nozzle plate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the basis of embodiments.

Embodiment 1

Figure 1:
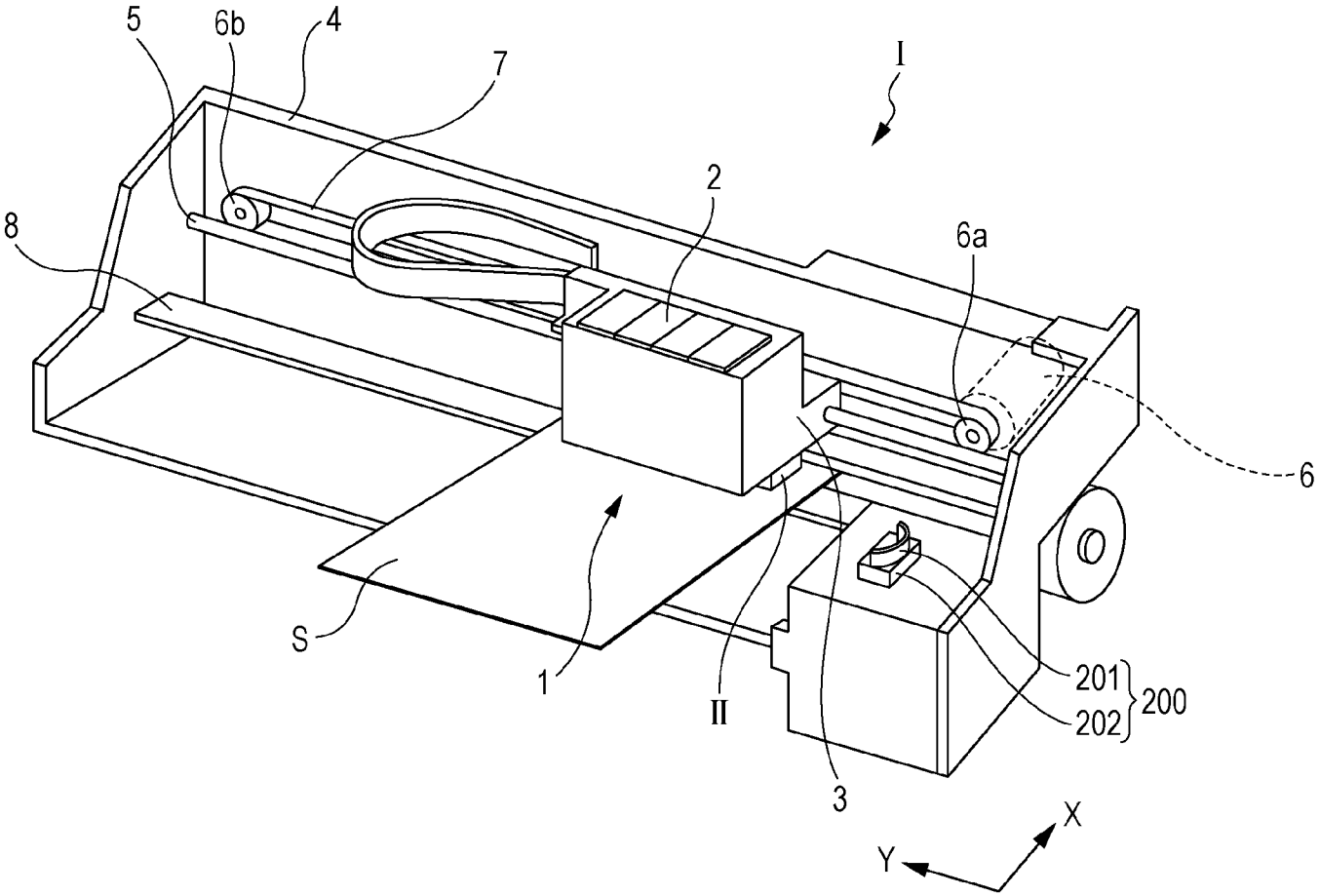
FIG. 1 is a schematic perspective view of a recording apparatus according to Embodiment 1 of the invention.

FIG. 1 is a perspective view that shows a schematic configuration of an ink jet type recording apparatus, which is an example of a liquid ejecting apparatus according to Embodiment 1 of the invention.

As shown in FIG. 1, an ink jet type recording apparatus I, which is a liquid ejecting apparatus of the present embodiment, is provided with an ink jet type recording head unit 1 (hereinafter, also referred to as a head unit 1) that has a plurality of ink jet type recording heads II (hereinafter, also referred to as recording heads II). Ink cartridges 2 that configure ink supply means are provided in the head unit 1 in a detachable manner, and a carriage 3 in which the head unit 1 is equipped is provided so as to be movable in an axial direction on a carriage axis 5 that is attached to an apparatus main body 4. The head unit 1 is set as a head unit that discharges a black ink composition and a color ink composition.

In addition, a driving motor 6 is provided in the vicinity of an end section of the carriage axis 5, and a first pulley 6*a* that has a groove at the outer periphery thereof is provided at a leading end section of the driving motor 6. Furthermore, a second pulley 6*b* is provided in a rotatable manner in the vicinity of the other end section of the carriage axis 5 so as to correspond with the first pulley 6*a* of the driving motor 6, and a timing belt 7 that is formed from an elastic member such as rubber is hung in ring-form between the first pulley 6*a* and the second pulley 6*b*.

Further, the carriage 3 in which the head unit 1 is equipped is moved along the carriage axis 5 by drive power of the driving motor 6 being transmitted to the carriage 3 through the timing belt 7. In the present embodiment, a movement direction of the carriage 3 is referred to as a main scanning direction. Meanwhile, a platen 8 is provided in the apparatus main body 4 along the carriage 3. The platen 8 is made so as to be able to rotate due to the driving force of a paper delivery motor that is not shown in the drawings, and so that recording sheets S, which are an ejection target medium (a recording medium) such as paper that is fed by a paper roller or the like, are transported by being wound around the platen 8. In the present embodiment, a transport direction of the recording sheets S is referred to as a sub-scanning direction.

In addition, a wiping section 200, which wipe a liquid ejecting surface 20*a* of the ink jet type recording head II that will be described in detail later by sweeping over the liquid ejecting surface 20*a*, are provided in a non-printing region of a side of the platen 8, which is an end section of the movement direction of the carriage 3.

Figure 2:
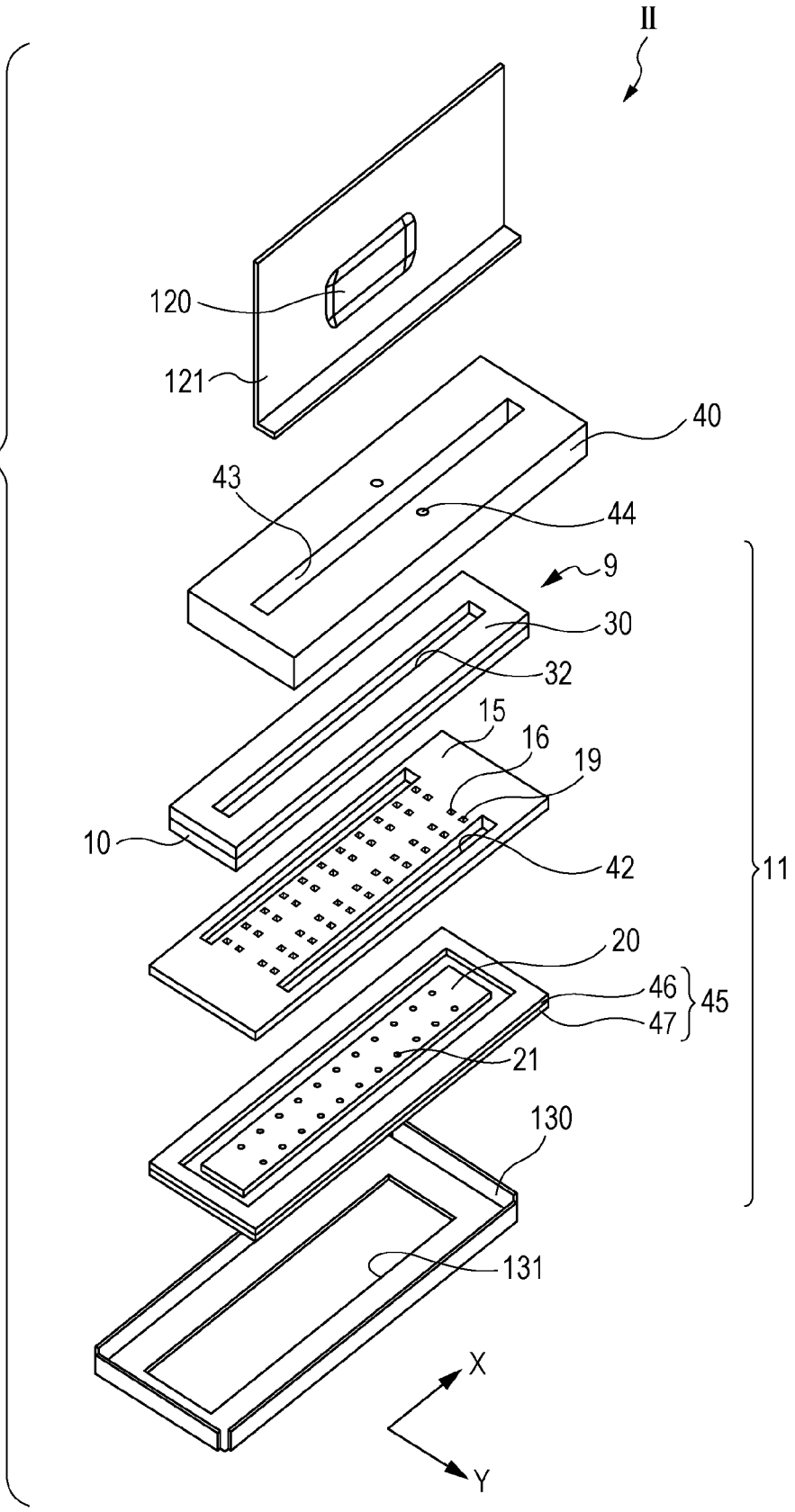
FIG. 2 is an exploded perspective view of a recording head according to Embodiment 1 of the invention.
Figure 3:
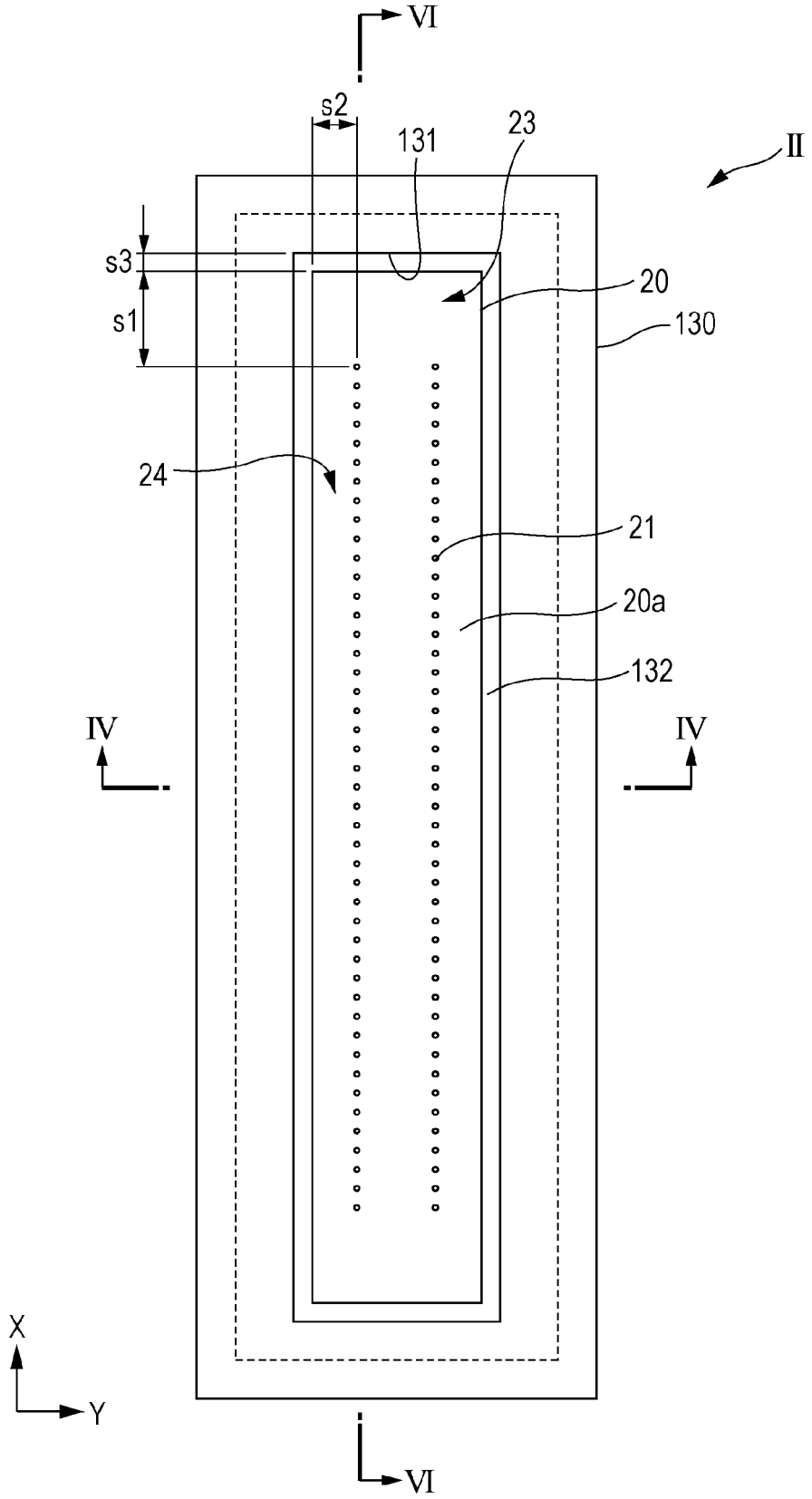
FIG. 3 is a plan view of a side of a liquid ejecting surface of the recording head according to Embodiment 1 of the invention.
Figure 4:
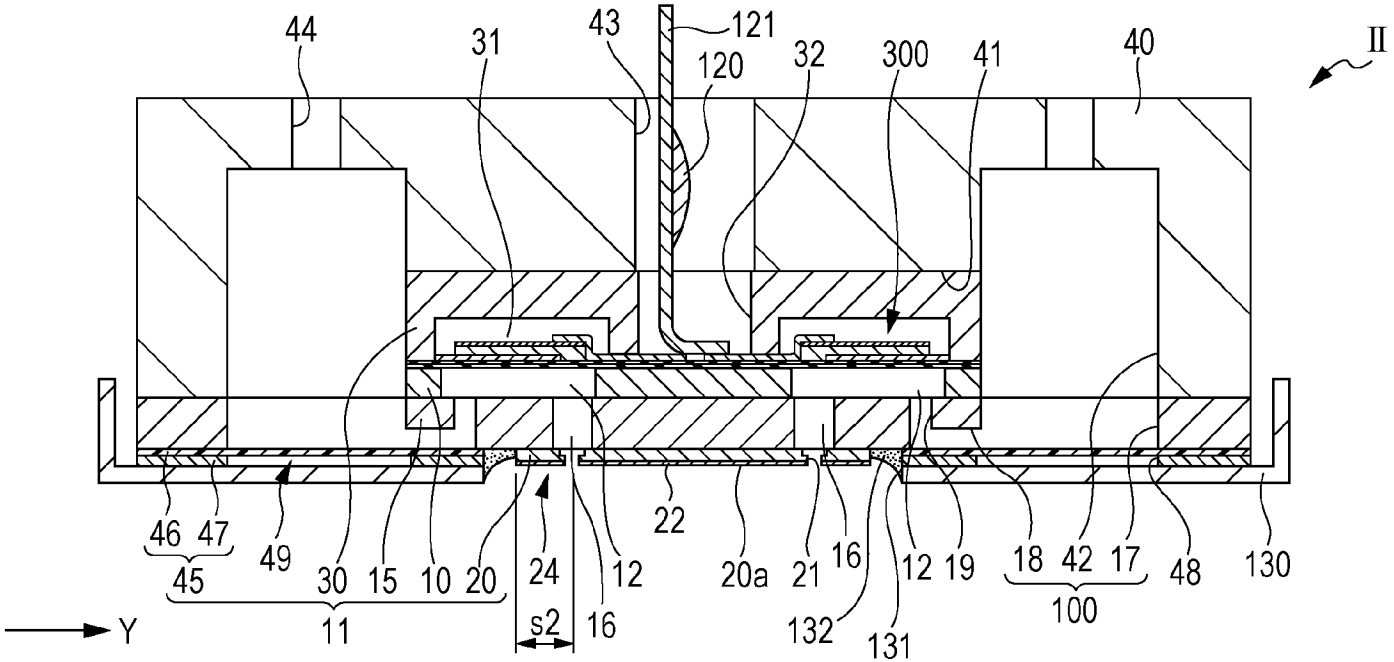
FIG. 4 is a cross-sectional view of the recording head according to Embodiment 1 of the invention.
Figure 5:
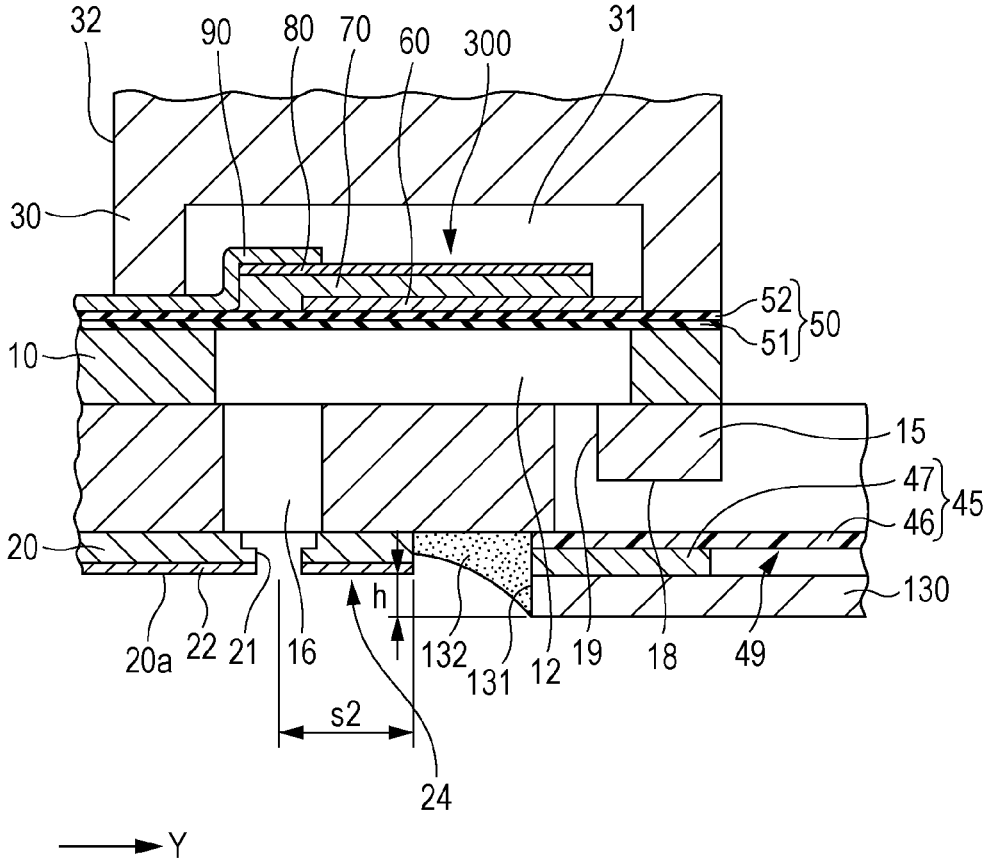
FIG. 5 is a cross-sectional view in which a main section of the recording head according to Embodiment 1 of the invention has been enlarged.
Figure 6A:
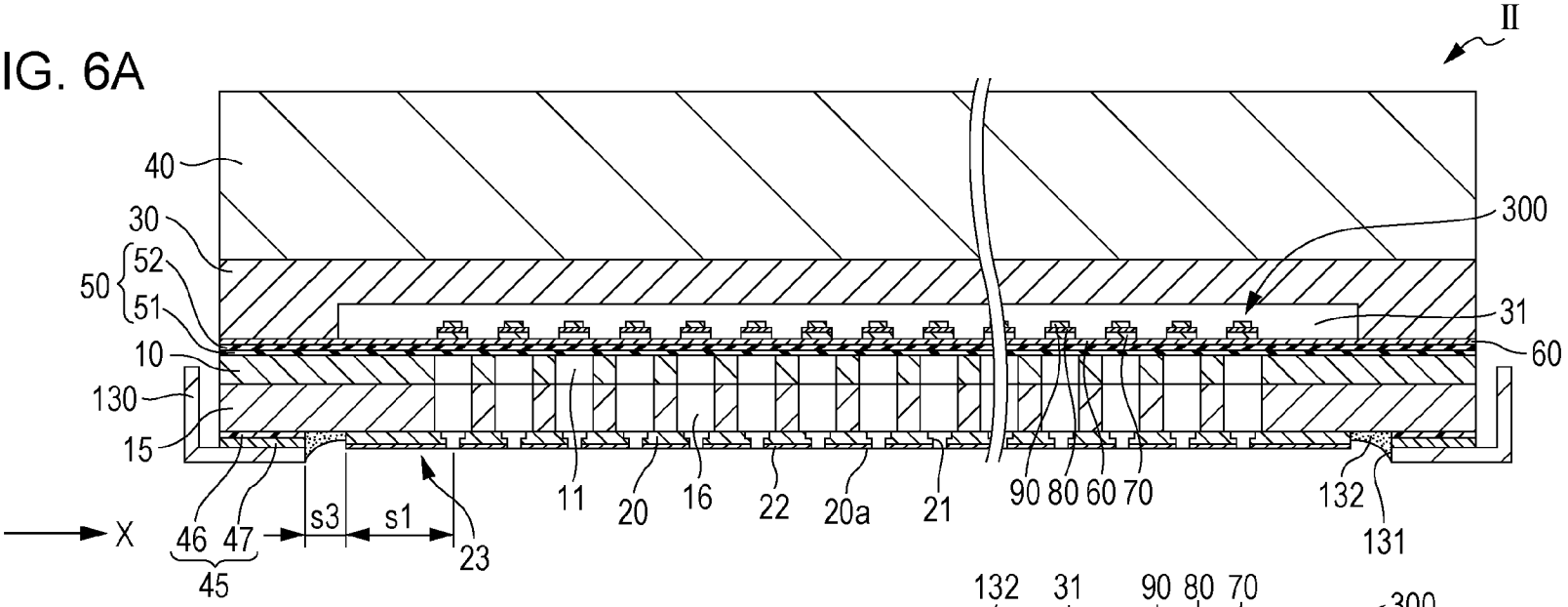
FIGS. 6A and 6B are cross-sectional views of the recording head according to Embodiment 1 of the invention.
Figure 6B:
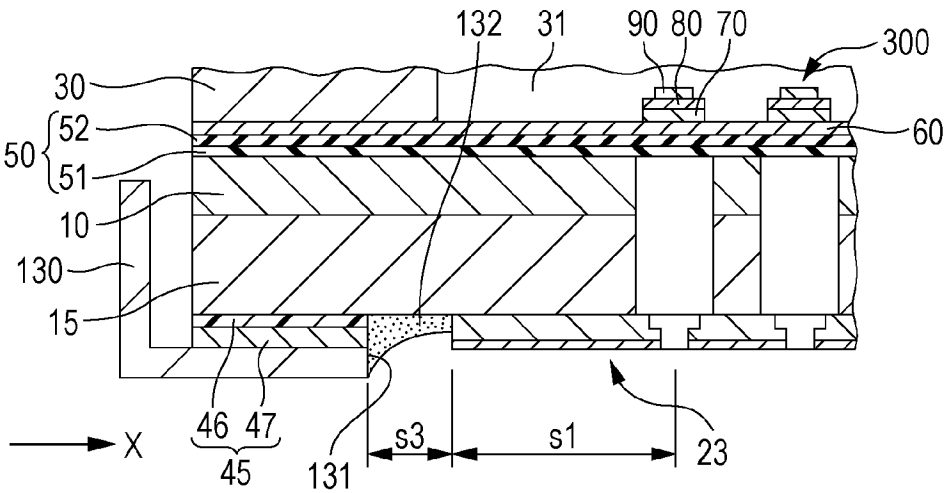

In this instance, an example of an ink jet type recording head that this kind of ink jet type recording apparatus is equipped with will be described with reference to FIGS. 2 to 7C. Additionally, FIG. 2 is an exploded perspective view of an ink jet type recording head, FIG. 3 is a plan view of a side of a liquid ejecting surface of the ink jet type recording head, FIG. 4 is a cross-sectional view along a line IV-IV of FIG. 3, and FIG. 5 is a view in which the main section of FIG. 4 has been enlarged. In addition, FIGS. 6A and 6B are a cross-sectional view along a line VI-VI of FIG. 3 and a view in which the main section of FIG. 6A has been enlarged.

As is illustrated in the drawings, the ink jet type recording head II of the present embodiment is provided with a plurality of members such as a head main body 11, a case member 40 and the like, and this plurality of members is joined using an adhesive or the like. In the present embodiment, the head main body 11 is provided with a flow channel formation substrate 10, a communication plate 15, a nozzle plate 20, a protective substrate 30, and a compliance substrate 45.

The flow channel formation substrate 10 that configures the head main body 11 can use a metal such as stainless steel or Ni, a ceramic material that is represented by $ZrO_2$ or $Al_2O_3$, a glass ceramic material, an oxide such as MgO or $LaAlO_3$ or the like. In the present embodiment, the flow channel formation substrate 10 is formed from a silicon monocrystalline substrate. A plurality of pressure generation chambers 12, which are partitioned by dividing walls, are arranged in parallel in the flow channel formation substrate 10 along a direction in which a plurality of nozzle openings 21, which discharge ink, are arranged in parallel, by performing anisotropic etching from a side of a surface of the flow channel formation substrate 10. Hereinafter, the direction thereof will be referred to as an arrangement direction of the pressure generation chambers 12 or as a first direction X. In addition, a plurality of rows in which the pressure generation chambers 12 are arranged in parallel in the first direction X are provided in the flow channel formation substrate 10, and in the present embodiment, two rows are provided. Hereinafter, a row arrangement direction in which rows of the pressure generation chambers 12, in which the pressure generation chambers 12 are formed along the first direction X, are arranged in plural will be referred to as a second direction Y.

In addition, the communication plate 15 is joined to a side of the surface of the flow channel formation substrate 10. In addition, the nozzle plate 20 through which the plurality of nozzle openings 21, which are in communication with each pressure generation chamber 12, penetrate is joined to the communication plate 15.

Nozzle communication routes 16, through which the pressure generation chambers 12 and the nozzle openings 21 are in communication, are provided on the communication plate 15. The communication plate 15 has an area that is larger than that of the flow channel formation substrate 10, and the nozzle plate 20 has an area that is smaller than that of the flow channel formation substrate 10. By making the area of the nozzle plate 20 comparatively small in this manner, it is possible to achieve a reduction in cost. Additionally, in the present embodiment, a surface in which the nozzle openings 21 of the nozzle plate 20 are opened, and from which ink droplets are discharged is referred to as the liquid ejecting surface 20*a*.

In addition, a first manifold section 17 and a second manifold section 18 that configure a section of a manifold 100 are provided on the communication plate 15.

The first manifold section 17 is provided so as to penetrate through the communication plate 15 in a thickness direction (a lamination direction of the communication plate 15 and the flow channel formation substrate 10).

In addition, the second manifold section 18 is provided so as to be open to a side of the nozzle plate 20 of the communication plate 15 without penetrating through the communication plate 15.

Furthermore, in the communication plate 15, a supply communication route 19 that is in communication with an end section in the second direction Y of the pressure generation chambers 12 is provided separately for each pressure generation chamber 12. The supply communication route 19 is in communication with the second manifold section 18 and the pressure generation chambers 12.

As this kind of communication plate 15, it is possible to use a metal such as stainless or Ni, a ceramic such as zirconium or the like. Additionally, it is preferable that the communication plate 15 is made from a material with a linear coefficient of expansion that is equivalent to that of the flow channel formation substrate 10. That is, in a case in which a material with a linear coefficient of expansion that differs greatly from the flow channel formation substrate 10 is used as the communication plate 15, heating and cooling causes warping due to the difference in the linear coefficients of expansion of the flow channel formation substrate 10 and the communication plate 15. In the present embodiment, by using the same material as the flow channel formation substrate 10, that is, a silicon monocrystalline substrate, as the communication plate 15, it is possible to suppress the generation of warping due to heating, and cracking, peeling and the like due to heating.

The nozzle openings 21, which are in communication with each pressure generation chamber 12 through the nozzle communication routes 16, are formed in the nozzle plate 20. That is, in the nozzle openings 21, openings that eject a liquid of the same kind (ink) are arranged in parallel in the first direction X, and rows of the nozzle openings 21 that are arranged in parallel in the first direction X form 2 rows in the second direction Y.

As this kind of nozzle plate 20, for example, it is possible to use a metal such as stainless steel (SUS), an organic substance such as a polyimide resin, a silicon monocrystalline substrate or the like. Additionally, by using a silicon monocrystalline substrate as the nozzle plate 20, the linear coefficients of expansion of the nozzle plate 20 and the communication plate 15 are set to be equivalent, and therefore, it is possible to suppress the generation of warping due to heating and cooling, and cracking, peeling and the like due to heating.

In addition, a liquid repellant film 22 that is liquid repellant (ink repellant) is provided on the liquid ejecting surface 20*a* of the nozzle plate 20. The liquid repellant film 22 is not particularly limited as long as the liquid repellant film 22 is ink repellant (liquid repellant) with respect to the ink that is discharged, and for example, can use a metal film that includes a fluorine-based polymer, a metal alkoxide molecular film that is liquid repellant or the like. Additionally, since, in the abovementioned manner, it is possible to reduce cost by forming the nozzle plate 20 with as small an area as possible, in the present embodiment, the liquid ejecting surface 20*a* has a rectangular shape in which a long side is provided along the first direction X, which is an arrangement direction of the nozzle openings 21.

Meanwhile, a vibration plate 50 is formed on a surface side of the flow channel formation substrate 10 that is opposite to the communication plate 15. In the present embodiment, an elastic film 51 that is formed from silicon oxide and provided on a side of the flow channel formation substrate 10, and an insulating body film 52 that is formed from zirconium oxide and provided on the elastic film 51, are provided as the vibration plate 50. Additionally, a liquid flow channel of the pressure generation chambers 12 and the like formed by performing anisotropic etching of the flow channel formation substrate 10 from a surface side (a surface side to which the nozzle plate 20 is joined), and the other surface of the liquid flow channel of the pressure generation chambers 12 and the like is demarcated by the elastic film 51.

In addition, on top of the insulating body film 52 of the vibration plate 50, a first electrode 60, a piezoelectric body layer 70 and a second electrode 80 configure a piezoelectric actuator 300, which in the present embodiment, is formed by lamination thereof using a film formation or a lithography technique. In addition, the protective substrate 30 that is substantially the same size as the flow channel formation substrate 10 is joined to a surface of a piezoelectric actuator 300 side of the flow channel formation substrate 10. The protective substrate 30 has a retention section 31, which is a space for protecting the piezoelectric actuator 300. In addition, a penetration hole 32 that penetrates through a thickness direction (a lamination direction of the flow channel formation substrate 10 and the protective substrate 30) is provided in the protective substrate 30. A second end section of a lead electrode 90 that is on an opposite side to that of a first end section that is connected to the second electrode 80 is provided to extend inside the penetration hole 32 in a manner in which it is exposed, and the lead electrode 90 and a wiring substrate 121, in which a driving circuit 120 such as a driving IC is mounted, are electrically connected by the penetration hole 32.

In addition, the case member 40, which, with the head main body 11, demarcates the manifold 100 that is in communication with the plurality of pressure generation chambers 12, is fixed to the head main body 11 that has this kind of configuration. The case member 40 has substantially the same shape in a plan view as the communication plate 15 that is mentioned above, and in addition to being joined to the protective substrate 30, is also joined to the communication plate 15 that is mentioned above. More specifically, the case member 40 has a concave section 41 with a depth of an extent that the flow channel formation substrate 10 and the protective substrate 30 can be accommodated on a protective substrate 30 side thereof. The concave section 41 has an opening area that is larger than a surface of the protective substrate 30 that is joined to the flow channel formation substrate 10. Further, an opening surface of a nozzle plate 20 side of the concave section 41 is sealed by the communication plate 15 in a state in which the flow channel formation substrate 10 and the like are accommodated in the concave section 41. As a result of this configuration, a third manifold section 42 is demarcated at an outer peripheral section of the flow channel formation substrate 10 by the case member 40 and the head main body 11. Further, the manifold 100 of the present embodiment is configured by the first manifold section 17 and the second manifold section 18 that are provided on the communication plate 15, and the third manifold section 42 that is demarcated by the case member 40 and the head main body 11.

Additionally, as the material of the case member 40, for example, it is possible to use a resin, a metal or the like. Incidentally, it is possible to mass produce the ink jet type recording heads at low cost by molding a resin material as the case member 40.

In addition, the compliance substrate 45 is provided on a surface of the communication plate 15 in which the first manifold section 17 and the second manifold section 18 are open. The compliance substrate 45 seals an opening of a liquid ejection surface side 20*a* side of the first manifold section 17 and the second manifold section 18.

In the present embodiment, this kind of compliance substrate 45 is provided with a sealing film 46, and a fixing substrate 47. The sealing film 46 is formed from a flexible thin film (for example, a thin film with a thickness of less than or equal to 20 μm that is formed by polyphenylene sulfide (PPS), stainless steel (SUS) or the like), and the fixing substrate 47 is formed with a hard material such as a metal like stainless steel (SUS) or the like. Since a region of the fixing substrate 47 that opposes the manifold 100 is an opening section 48 which is completely removed in the thickness direction, a surface of the manifold 100 is a compliance section 49, which is a flexible section that is sealed by the flexible sealing film 46 only.

Additionally, an introduction route 44 for supplying ink to each manifold 100 is provided in the case member 40 in communication with the manifolds 100. In addition, a connection aperture 43 into which the wiring substrate 121 is inserted, is provided in the case member 40 in communication with the penetration hole 32 of the protective substrate 30.

In the ink jet type recording head II that has this kind of configuration, when ink is ejected, ink is taken in from the ink cartridges 2 through the introduction route 44, and the inside of a flow channel that reaches from the manifolds 100 to the nozzle openings 21 is filled with ink. Subsequently, deflection deformation of the piezoelectric actuator 300 and the vibration plate 50 is caused by applying a voltage to each piezoelectric actuator 300 that corresponds to the pressure generation chambers 12 according to a signal from the driving circuit 120. As a result of this configuration, pressure inside the pressure generation chambers 12 increases, and ink droplets are ejected from predetermined nozzle openings 21. Additionally, in the ink jet type recording head II of the present embodiment, a section from the connection aperture 43 to the nozzle openings 21 is referred to as the liquid flow channel. That is, the liquid flow channel is configured by the connection aperture 43, the manifolds 100, the supply communication route 19, the pressure generation chambers 12, the nozzle communication routes 16 and the nozzle openings 21.

In addition, a cover head 130, which is a protective member of the present embodiment, is provided on a liquid ejecting surface 20*a* side of the head main body 11. The cover head 130 is joined to a surface side of the compliance substrate 45 that is opposite to the communication plate 15, and seals a space of a side that is opposite a flow channel (the manifold 100) of the compliance section 49. Additionally, an exposure opening section 131, which is an opening section that includes the nozzle openings 21, and that exposes the liquid ejecting surface, is provided in the cover head 130. In the present embodiment, the exposure opening section 131 has an opening of a size that exposes the nozzle plate 20, or in other words, the same opening as the compliance substrate 45. That is, the nozzle plate 20 of the present embodiment has an area that is smaller than the opening area of the exposure opening section 131. As a result of this configuration, it is possible to reduce the cost of the nozzle plate 20. That is, since, in addition to the nozzle openings 21 being formed with high precision, the liquid repellant film 22 is formed on the nozzle plate 20, it is possible to reduce cost by making the area of the nozzle plate 20 smaller. In addition, although a number of nozzle plates 20 that can be obtained from a single silicon wafer is determined by the area of the nozzle plate 20 in a case in which a plurality of nozzle plates 20 are formed simultaneously on a single silicon wafer, if the area of the nozzle plate 20 is large, the number is low, and therefore, there is an increase in cost. Additionally, by forming the nozzle plate 20 with an area that is smaller than the opening area of the exposure opening section 131, an interval is formed between an end section of the nozzle plate 20 and the cover head 130, which is a protective member. Additionally, since the nozzle plate 20 as a rectangular shape in which, in the abovementioned manner, a direction along the first direction X is the long side, the exposure opening section 131 of the cover head 130 is also formed with an opening that has the same rectangular shape that has a long side along the first direction X as the nozzle plate 20.

In the present embodiment, this kind of cover head 130 is provided so as to protrude further on a recording sheet S side than the liquid ejecting surface 20*a* of the nozzle plate 20 in a discharge direction of the ink (the liquid). In this manner, by causing the cover head 130 to protrude further on a recording sheet S side than the liquid ejecting surface 20*a*, it becomes unlikely that the recording sheets S will come into contact with the nozzle plate 20, and therefore, it is possible to suppress the generation of deformation and peeling of the nozzle plate 20 that is caused by the recording sheets S coming into contact with the nozzle plate 20.

In addition, in the same manner as the nozzle plate 20, the cover head 130 may be configured so that a liquid repellant film is provided on a surface of this kind of cover head 130 that is the same side as the liquid ejecting surface 20*a*, that is, a surface of a side that is opposite to the compliance substrate 45.

In addition, in the present embodiment, a space between the nozzle plate 20 and the exposure opening section 131 of the cover head 130 is filled with a filler 132. The filler 132 is formed to be at a position that is lower than the liquid ejecting surface 20*a* on the nozzle plate 20 side (a direction that is opposite to a liquid ejection direction), and a position that is lower than a surface of the cover head 130 on a cover head 130 side. As a result of this configuration, although this will be described in more detail later, it is possible to suppress a circumstance in which the wiping section 200 comes into contact with the filler 132 when the wiping section 200 sweeps over the surface of the cover head 130 and the liquid ejecting surface 20*a* of the nozzle plate 20, and foreign matter is generated due to peeling of the filler 132. In addition, by providing the filler 132 in this manner, ink is retained between the nozzle plate 20 and the cover head 130, and therefore, it is possible to suppress a circumstance in which retained ink stains the recording sheets S by dripping onto the recording sheets S at an unexpected timing.

Additionally, the filler 132 is not particularly limited as long as the filler 132 is a material that is resistant to liquid, and for example, can use a filler or the like. In addition, the filler 132 may be a section of the adhesive that bonds the cover head 130 to the compliance substrate 45, for example.

The ink jet type recording apparatus I is equipped with this kind of ink jet type recording head II in a manner in which the second direction Y is the main scanning direction, which is a movement direction of the carriage 3.

In addition, the wiping section 200, which will be described in detail later, is provided in the ink jet type recording apparatus I, and the wiping section 200 sweeps over the liquid ejecting surface 20*a* of the ink jet type recording head II by moving in the second direction Y. That is, the second direction Y of the present embodiment is a sweeping direction of the wiping section 200.

As shown in FIG. 3, in this kind of ink jet type recording head II, a distance s1 in the first direction X of a first blank space section 23 of an end section of the nozzle plate 20 and a nozzle opening 21 that is provided on a side of the end of the nozzle plate 20 (an end nozzle opening 21) is longer than a distance s2 in the second direction Y of a second blank space section 24 of an end section of the nozzle plate 20 and a nozzle opening 21 that is provided on a side of the end of the nozzle plate 20 (an end nozzle opening 21).

That is, the second blank space section 24 is a blank space portion of the second direction Y, which is a sweeping direction of the wiping section 200. In addition, the first blank space section 23 is a blank space portion of the first direction X, which is an orthogonal direction that is orthogonal to the sweeping direction (the second direction Y). In addition, the first blank space section 23 and the second blank space section 24 are portions on the liquid ejecting surface 20*a*, and do not include an outer side of the nozzle plate 20, that is, an interval between the nozzle plate 20 and the cover head 130, which is a protective member. In addition, in the present embodiment, the distances s1 and s2 of the first blank space section 23 and the second blank space section 24 respectively refer to a distance from the center of the nozzle opening 21 to an end of the nozzle plate 20.

Additionally, although the distance s2 of the second blank space section 24 will be described in more detail later, in a case in which a blade section 201 of the wiping section 200 lands upon the second blank space section 24 of the liquid ejecting surface 20*a* after sweeping across the cover head 130, the distance s2 also depends on a movement speed of the wiping section 200, but for example, in a case in which the movement speed of the blade section 201 is 80 mm/s, is greater than or equal to 0.05 mm but less than or equal to 0.3 mm.

In addition, for example, in a case in which a protrusion amount h of the cover head 130 from the liquid ejecting surface 20*a* that is shown in FIG. 5 is formed to be greater than or equal to 30 μm but less than or equal to 100 μm, and an interval s3 between the cover head 130 and an end of the nozzle plate 20 in the second direction Y that is shown in FIG. 3 is greater than or equal to 0.05 mm but less than or equal to 0.3 mm, it is preferable that the distance s1 of the first blank space section 23 be greater than or equal to 0.8 mm but less than or equal to 3.0 mm, and greater than or equal to 1.0 mm but less than or equal to 2.0 mm is preferred. Although this will be described in more detail later, the reason for this is that it is possible to reliably sweep over the vicinity of the end nozzle opening 21 using the wiping section 200 when the liquid ejecting surface 20*a* of the nozzle plate 20 is swept over by the wiping section 200.

Additionally, the protrusion amount h of the cover head 130 from the liquid ejecting surface 20*a* is a height of a difference in level between the liquid ejecting surface 20*a* of the nozzle plate 20 and a surface of the cover head 130 that is on a side that is opposite to the compliance substrate 45.

In addition, a the interval s3 between the cover head 130 and an end of the nozzle plate 20 is an interval between an opening edge section of the exposure opening section 131 of the cover head 130 and the end section of the nozzle plate 20.

Figure 7A:
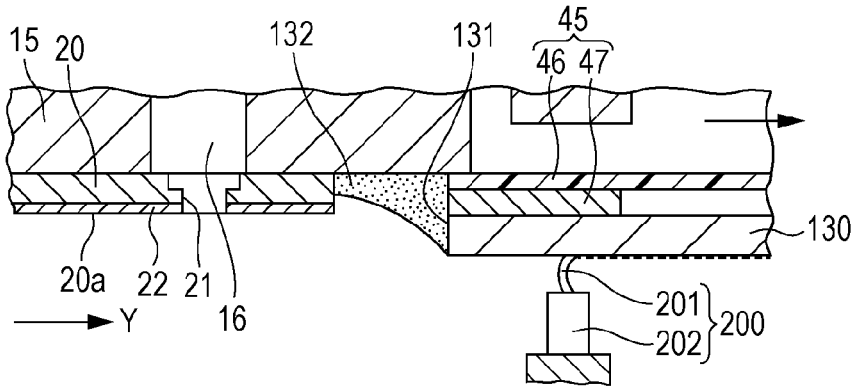
FIGS. 7A to 7C are cross-sectional views that show actions of the recording apparatus according to Embodiment 1 of the invention.
Figure 7B:
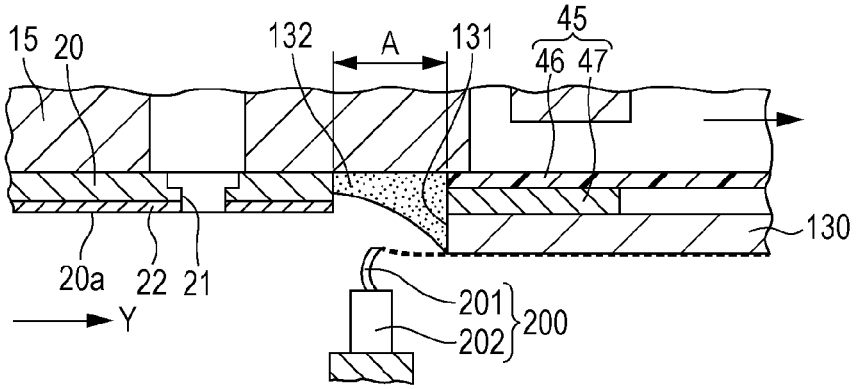
Figure 7C:
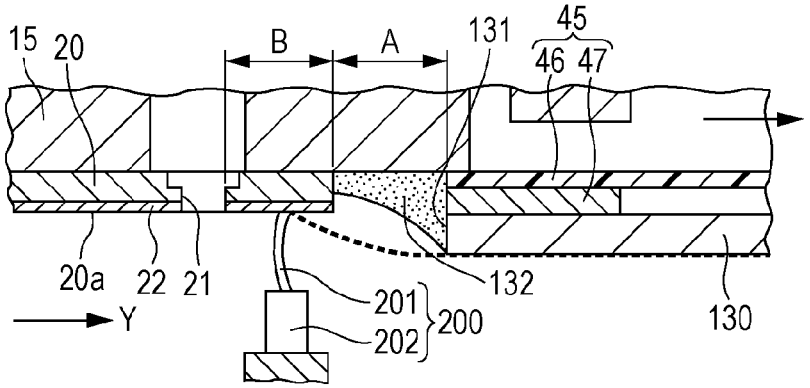
Figure 8:
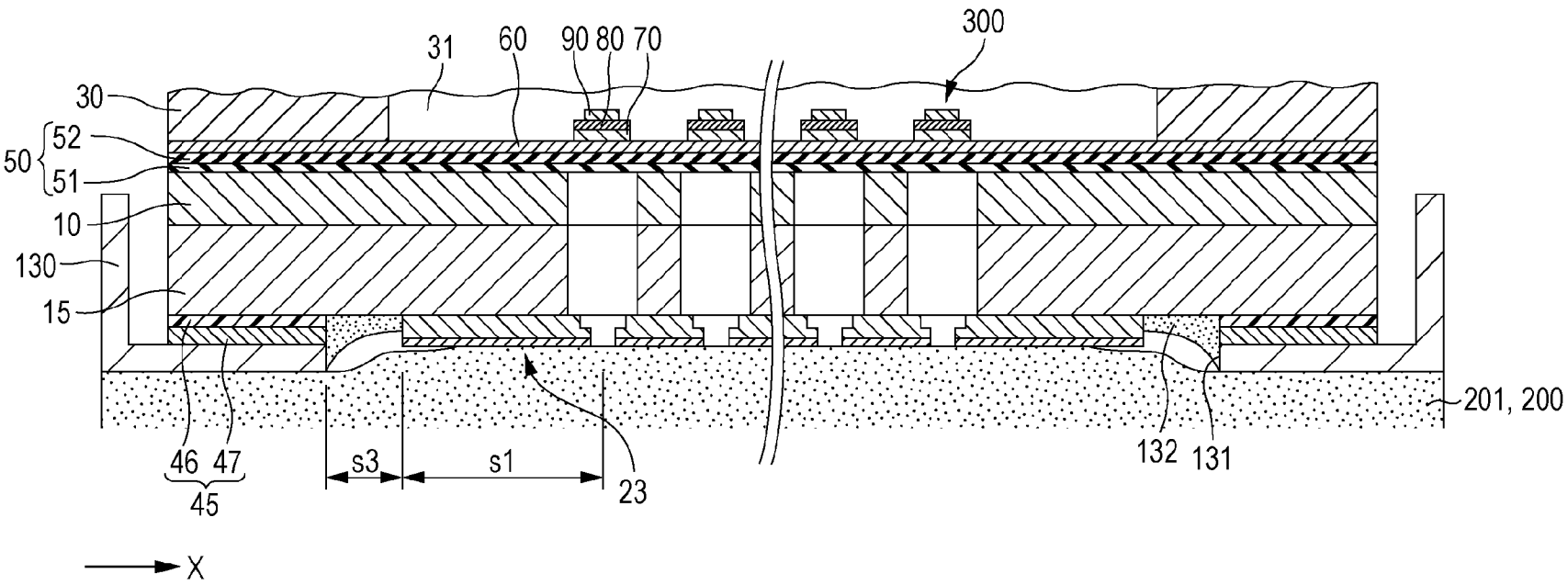
FIG. 8 is a cross-sectional view that shows an action of the recording apparatus according to Embodiment 1 of the invention.

Next, the wiping section 200 that wipes the liquid ejecting surface 20*a* of the ink jet type recording head II will be described with reference to FIG. 1, FIGS. 7A to 7C and FIG. 8. Additionally, FIGS. 7A to 7C are main section cross-sectional views of the second direction Y that describe a wiping action, and FIG. 8 is a main section cross-sectional view of the first direction X that describes a wiping action.

In the present embodiment, the wiping section 200 is provided with the blade section 201 that is formed from a plate-shaped member that is formed with an elastic material such as rubber or elastomer, and a base section 202 to which the blade section 201 is fixed.

As shown in FIG. 1, the base section 202 is disposed in an outside region of a region of the ink jet type recording apparatus I in which ink is landed upon a recording sheet S, or in other words, in a non-printing region, in a position that mutually opposes the liquid ejecting surface 20*a*. The base section 202 may be provided so as to be moveable in the discharge direction of ink, for example.

A base end section of the blade section 201 is fixed to the base section 202 in a manner in which a leading end thereof is becomes a free end. In addition, the blade section 201 is disposed in a manner in which the leading end, which becomes a free end, protrudes toward the liquid ejecting surface 20*a* so that a surface direction is the first direction X.

In addition, the blade section 201 is disposed in a state of being curved with respect to a straight line of the first direction X so that a surface thereof becomes concave.

This kind of blade section 201 is provided so that a length in the first direction X thereof is longer than a length in the first direction X of a row of nozzle openings 21 that are provided in the nozzle plate 20. In addition, in the present embodiment, the length in the first direction X of the blade section 201 is longer than the length in the first direction X of the cover head 130. As a result of this configuration, the blade section 201 can sweep across the entire surfaces of the surface of the cover head 130 and the liquid ejecting surface 20*a*.

This kind of wiping section 200 wipes the liquid ejecting surface 20*a* by the leading end of the blade section 201 sweeping across the liquid ejecting surface 20*a* due to the blade section 201 moving relatively in the second direction Y with respect to the ink jet type recording head II.

In this instance, in the present embodiment, the relative movement between the blade section 201 (the wiping section 200) and the ink jet type recording head II is performed by moving the carriage 3 in which the ink jet type recording head II is equipped in the main scanning direction (the second direction Y). Naturally, the relative movement of the wiping section 200 and the ink jet type recording head II is not limited to movement of the carriage 3, and a movement means or the like that moves the wiping section 200 in the main scanning direction (the second direction Y) may be provided and the wiping section 200 may be moved in a state in which the carriage 3 in which the ink jet type recording head II is equipped, is stopped. In addition, the wiping section 200 may be configured to move relatively in the sub-scanning direction with respect to the ink jet type recording head II, and the blade section 201 may sweep over the liquid ejecting surface 20*a* in the first direction X.

The blade section 201 of this kind of wiping section 200 sweeps over the liquid ejecting surface 20*a* of the nozzle plate 20 after sweeping over the surface of the cover head 130.

More specifically, as shown in FIG. 7A, the leading end of the blade section 201 sweeps over the surface of the cover head 130 (the liquid ejecting surface 20*a* side) as a result of the ink jet type recording head II being moved relatively in the second direction Y with respect to the wiping section 200. As a result of this configuration, ink (liquid), fluff, dust, paper powder and the like that have become attached to the surface of the cover head 130 are wiped.

Further, as shown in FIG. 7B, when the ink jet type recording head II is further moved relatively in the second direction Y with respect to the wiping section 200, the leading end of the blade section 201 is separated from an end section of a nozzle plate side of the cover head 130, and as shown in FIG. 7C, lands upon a region B of the liquid ejecting surface 20*a* between the nozzle openings 21 of the nozzle plate 20 and an end section of the nozzle plate 20 of a side that is opposite to the sweeping direction (the second direction Y in the present embodiment), that is, the second blank space section 24. In addition, the end section of the nozzle plate 20 of a side that is opposite to the sweeping direction refers to a section that is an end section of the nozzle plate 20, and is an end section of a side of the cover head 130 of a region that the blade section 201 has already swept over. Furthermore, among the nozzle openings 21, a nozzle opening 21 that the region B defines refers to a nozzle opening that is provided furthest on a side of an end section that is on a side that is opposite to the sweeping direction of the nozzle plate 20, and is an edge section of the opening of the side of the end section that is on a side that is opposite to the sweeping direction of the nozzle plate 20. That is, the region B is between an opening edge section of the nozzle opening 21 that is provided furthest on a side of an end section that is on a side that is opposite to the sweeping direction of the nozzle plate 20, and an end section that is on a side that is opposite to the sweeping direction of the nozzle plate 20, and is a region that does not include an opening edge section of the nozzle opening 21 and an end surface of the nozzle plate 20.

Further, as shown in FIG. 7C, by further moving the ink jet type recording head II relatively in the second direction Y with respect to the wiping section 200 after the blade section 201 has landed upon the region B of the liquid ejecting surface 20*a*, the blade section 201 performs wiping of the vicinity of the nozzle openings 21 by passing over the nozzle openings 21. In addition, after the wiping of the liquid ejecting surface 20*a* has been performed, and wiping is completed by performing wiping of the surface of the cover head 130 due to the blade section 201 being further swept over the surface of the cover head 130 in the second direction Y.

In addition, as shown in FIG. 8, the blade section 201 is pushed against the surface of the cover head 130 in the first direction X, and a portion of the blade section 201 that protrudes due to deformation inside the exposure opening section 131 comes into contact with and sweeps over the liquid ejecting surface 20*a* of the nozzle plate 20.

At this time, by setting the distance s1 of the first blank space section 23 to be longer than the distance s2 of the second blank space section 24 in the manner mentioned above, the deformation of the blade section 201 is stable, and therefore, it is possible to reliably sweep across and wipe the vicinity of the end nozzle opening 21 using the blade section 201.

That is, in the present embodiment, the liquid ejecting surface 20*a* is swept across by the blade section 201 by causing the ink jet type recording head II to move relatively in the second direction Y with respect to the wiping section 200. In other words, the blade section 201 moves relatively along a short side of the exposure opening section 131 that is open in a rectangular shape, is deformed so as to protrude toward the liquid ejecting surface 20*a*, which is a sunken position inside the exposure opening section 131, from the surface of the cover head 130 and comes into contact with the liquid ejecting surface 20*a*. Since the blade section 201 that sweeps across the liquid ejecting surface 20*a* has a long shape along the long side of the exposure opening section 131, the blade section 201 has a tendency to fall toward the liquid ejecting surface 20*a* along a long side of the exposure opening section 131 in the vicinity of the long side. In contrast to this, in the vicinity of a short side portion of the exposure opening section 131, since the blade section 201 is deformed by extending over the difference in levels between the surface of the cover head 130 and the liquid ejecting surface 20*a*, the blade section 201 has a tendency not to fall toward the liquid ejecting surface 20*a* in the vicinity of the short side of the exposure opening section 131, that is, the vicinity of the end section of the liquid ejecting surface 20*a* in the first direction X, and therefore, there is a tendency for the blade section 201 not to come into contact with the end section of the liquid ejecting surface 20*a*. Therefore, even if the distance s2 of the second blank space section 24 is set to be comparatively short, it is possible for the blade section 201 to land upon the second blank space section 24. In addition, by setting the distance s1 of the first blank space section 23 to be longer than the second blank space section 24, the deformation of the blade section 201 at the first blank space section 23 is stable, and therefore, it is possible to reliably sweep across and wipe the vicinity of the end nozzle opening 21 using the blade section 201.

Figure 9:
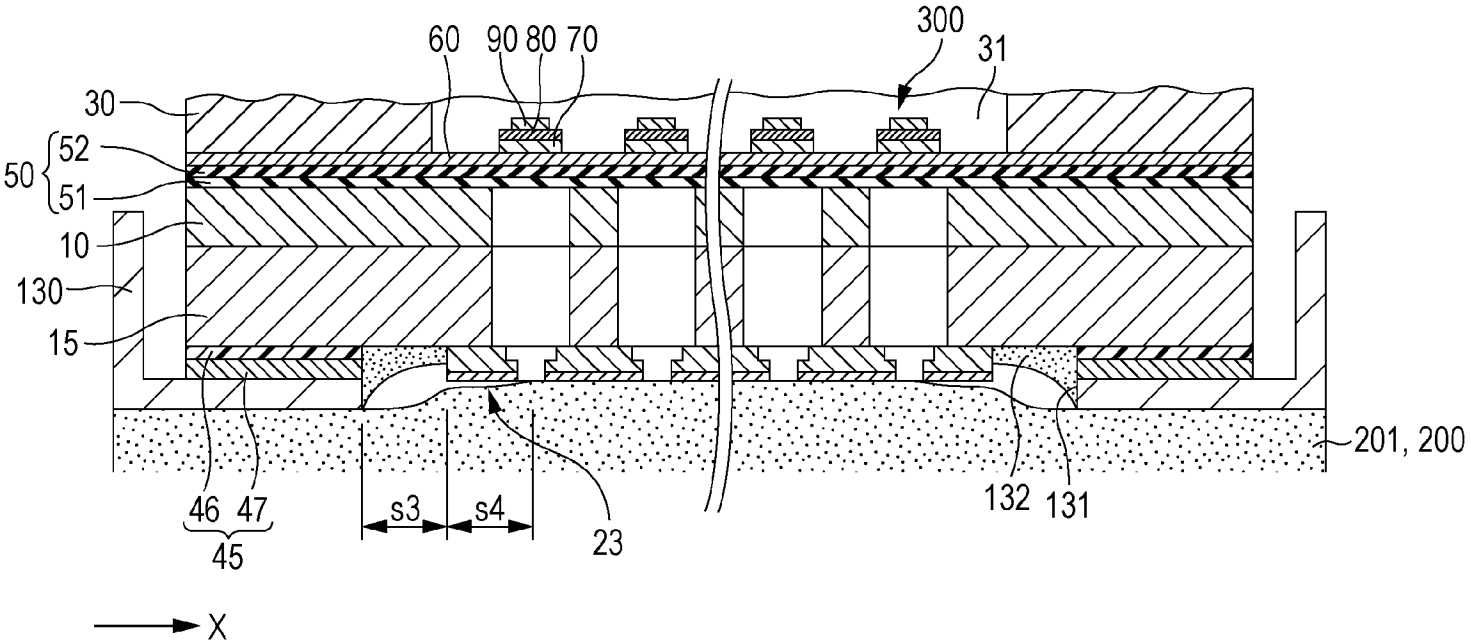
FIG. 9 is a cross-sectional view that shows a comparative example of the recording head according to Embodiment 1 of the invention.

In contrast to this, in a case in which, for example, as shown in FIG. 9, the first blank space section 23 is smaller than the distance s1, that is, setting to a distance s4 that is shorter than the distance s1, a distance s4+s3 between the cover head 130 and the end nozzle opening 21 becomes small, and therefore, there is a concern that the deformation of the blade section 201, and the deformation in the vicinity of the end nozzle opening 21 in particular will not be stable, and the vicinity of the end nozzle opening 21 will remain unwiped by the blade section 201.

Figure 10:
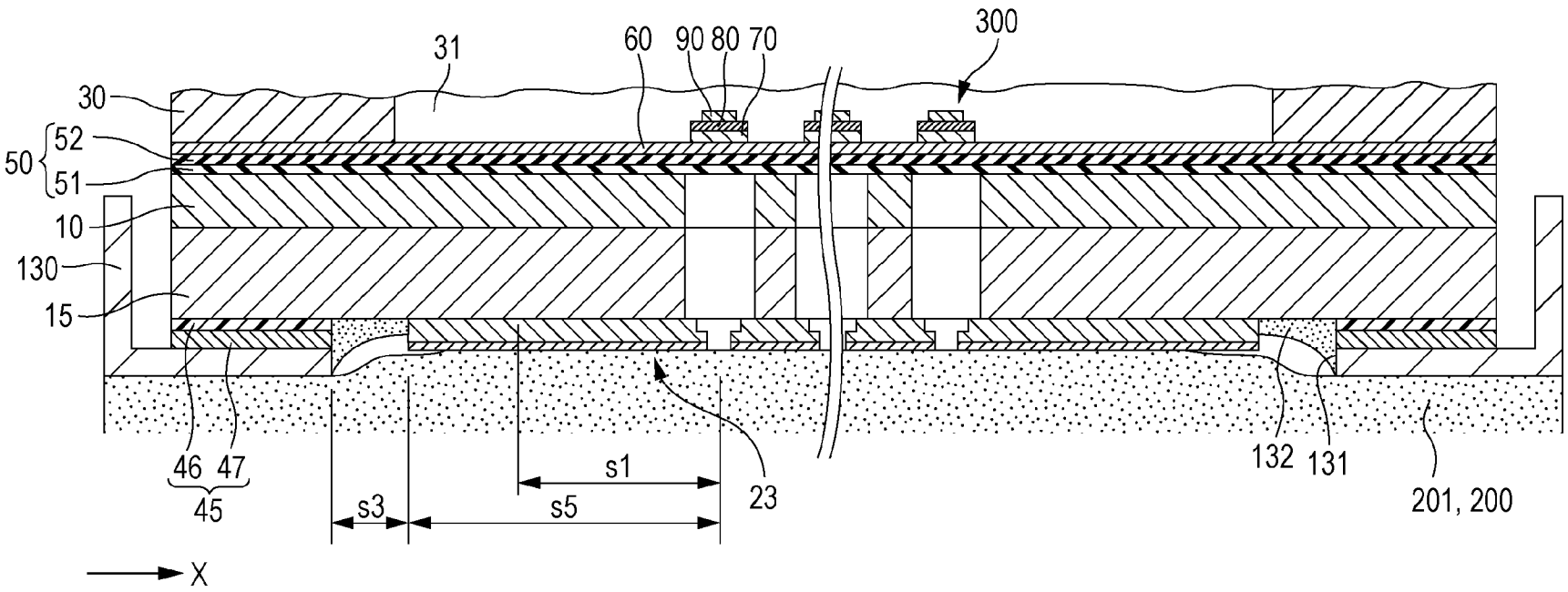
FIG. 10 is a cross-sectional view that shows a comparative example of the recording head according to Embodiment 1 of the invention.

In addition, in a case in which, for example, as shown in FIG. 10, the first blank space section 23 is set to a distance s5 that is significantly longer than the distance s1, although it is possible for the nozzle plate 20 to be reliably swept across by the blade section 201, there is an increase in the size of the nozzle plate 20. For example, in a case in which a plurality of nozzle plates 20 are formed simultaneously in a single silicon wafer, the number of nozzle plates 20 that can be obtained from a single silicon wafer is reduced. In addition, if the size of the nozzle plate 20 is increased, the exposure opening section 131 must be formed with a large opening area, and therefore, in addition to an increase in the size of the cover head 130, an increase in the size of the blade section 201 is also necessary. In this manner, an increase in the ink jet type recording head II is caused by an increase in the size of the nozzle plate 20, and therefore, an increase in cost is also caused. In the present embodiment, by setting the distance s1 of the first blank space section 23 to be less than or equal to 3.0, and preferably less than or equal to 2.0 mm, an increase in the size of the nozzle plate 20 is significantly suppressed, and therefore, it is possible to reduce cost.

Figure 11:
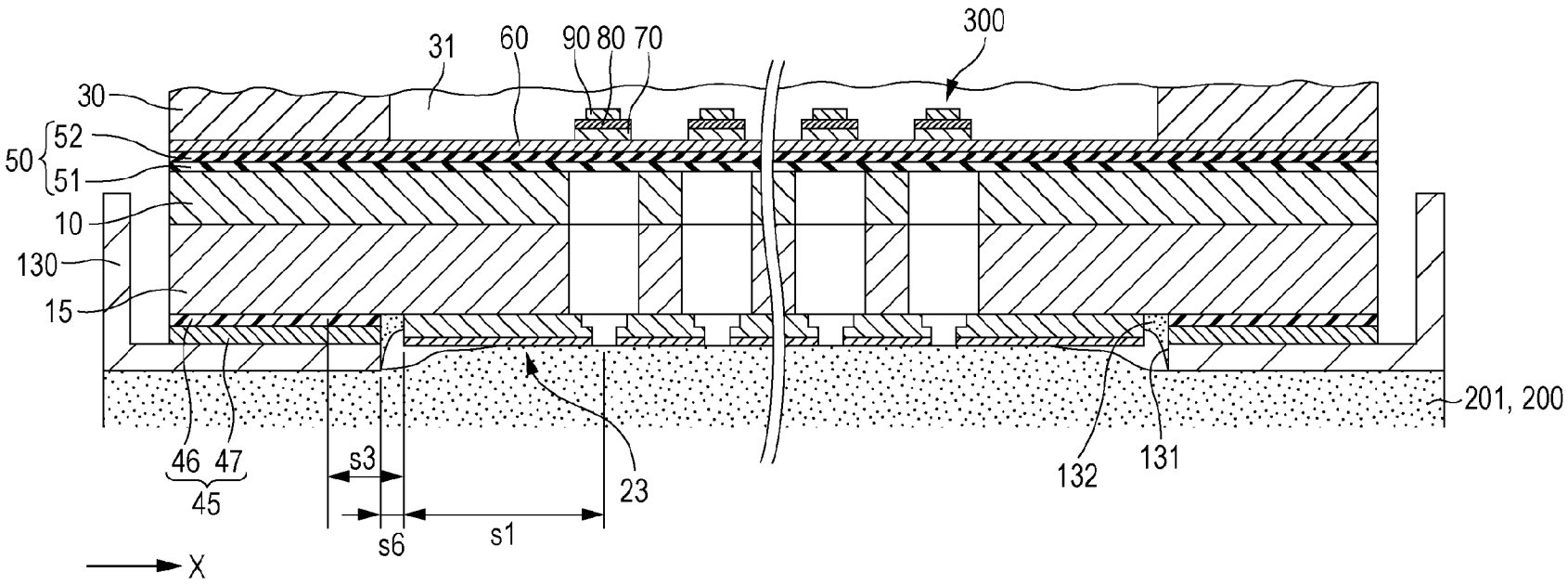
FIG. 11 is a cross-sectional view that shows a comparative example of the recording head according to Embodiment 1 of the invention.

In addition, as shown in FIG. 11, in a case in which the interval in the first direction X between the cover head 130 and the nozzle plate 20 is set to an interval s6 that is significantly smaller than the interval s3, a distance s1+s6 between the cover head 130 and the end nozzle opening 21 becomes small, and therefore, there is a concern that the deformation of the blade section 201, and the deformation in the vicinity of the end nozzle opening 21 in particular will not be stable, and the vicinity of the end nozzle opening 21 will remain unwiped by the blade section 201. In the present embodiment, by setting the interval s3 between the cover head 130 and an end of the nozzle plate 20 to be greater than or equal to 0.05 mm but less than or equal to 0.3 mm, deformation of the blade section 201 is stabilized, and therefore, it is possible to reliably perform sweeping across the vicinity of the end nozzle opening 21. In addition, in the present embodiment, since the end section of the nozzle plate 20 is sufficiently separated from the cover head 130, a circumstance in which the blade section 201 comes into contact with the end section of the nozzle plate 20 is suppressed, and therefore, it is possible to suppress peeling of the liquid repellant film 22 that is caused by the blade section 201 coming into contact with the end section of the nozzle plate 20, deteriorations in the longevity of the blade section 201 and damage to the nozzle plate 20.

Figure 12:
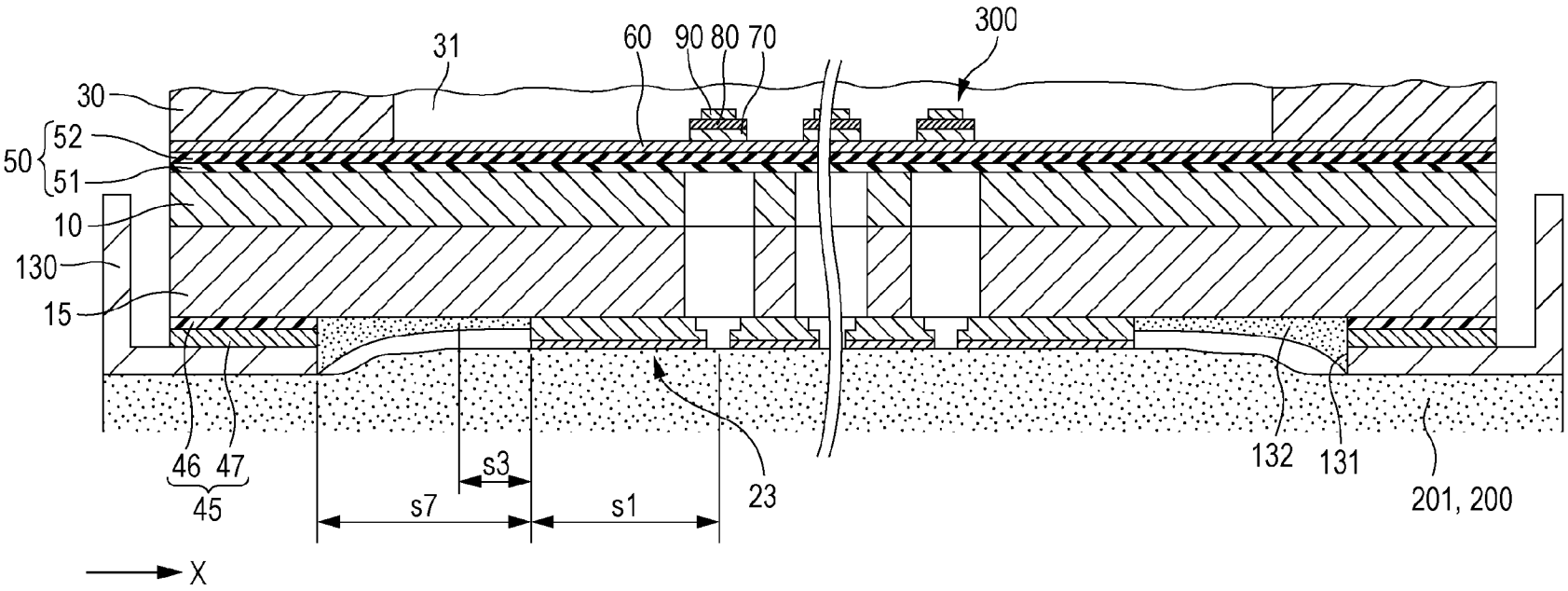
FIG. 12 is a cross-sectional view that shows a comparative example of the recording head according to Embodiment 1 of the invention.

In addition, as shown in FIG. 12, in a case in which the interval in the first direction X between the cover head 130 and the nozzle plate 20 is set to an interval s7 that is significantly larger than the interval s3, although it is possible for the nozzle plate 20 to be reliably swept across by the blade section 201, there is an increase in the size of the cover head 130, and therefore, an increase in cost. In the present embodiment, by setting the interval s3 interval between the cover head 130 and an end of the nozzle plate 20 to be greater than or equal to 0.05 mm but less than or equal to 0.3 mm, it is possible to suppress an increase in the size of the cover head 130, and therefore, to reduce cost.

Incidentally, in a case in which, as shown in FIG. 9, the distance of the first blank space section 23 of the nozzle plate 20 is set to a short distance s4, although it is conceivable that a distance s4+s7 between the cover head 130 and the end nozzle opening 21 would be set to the same distance as the s1+s3 by setting the interval s3 between the nozzle plate 20 and the cover head 130 to be larger than the interval s7, even if the end nozzle opening 21 is sufficiently separated from the cover head 130, if there is not a sufficient distance in the first blank space section 23 of the liquid ejecting surface 20*a* of the nozzle plate 20 in the manner of the distance s1, the deformation of the blade section 201 is not stable, and therefore, the end nozzle opening 21 remains unwiped.

In the present embodiment, by setting the distance s1 of the first blank space section 23 to be longer than the distance s2 of the second blank space section 24, deformation of the blade section 201 is stabilized, and therefore, it is possible to reliably perform sweeping across the vicinity of the end nozzle opening 21.

Additionally, if the second blank space section 24, which is a region B of the liquid ejecting surface 20*a*, and a region A between the liquid ejecting surface 20*a* and the cover head 130 are made to be wide, in addition to an increase in the size of the ink jet type recording head, there is an increase in cost. Therefore, by providing the region A and the region B to be as narrow as possible, it is possible to reduce the size of the ink jet type recording head II. In particular, in the present embodiment, since the wiping section 200 sweeps over the liquid ejecting surface 20*a* by moving relatively in the second direction Y, if the region B of the nozzle opening 21 and the end section of the nozzle plate 20 that is on a side that is opposite to the sweeping direction is large, since there is a concern that a distance between nozzle rows will become long when a plurality of ink jet type recording heads II are equipped, it is preferred if the second blank space section 24, which is the region B, is set to be as narrow as possible.

In the abovementioned manner, as a result of the blade section 201 wiping a surface of the liquid ejecting surface 20*a* side of the cover head 130, it is possible to suppress stains from becoming attached to the recording sheets S due to foreign matter such as ink that is attached to the cover head 130. In addition, by making the distance s1 of the first blank space section 23 of the nozzle plate 20 longer than the distance s2 of the second blank space section 24, it is possible to reliably sweep over the entire nozzle opening 21 with the blade section 201.

Additionally, in the present embodiment, by setting the distance s1 of the first blank space section 23 to be less than or equal to 3.0 mm, and preferably less than or equal to 2.0 mm, a circumstance in which the blade section 201 comes into contact with the end section of the nozzle plate 20 is suppressed, and therefore, it is possible to suppress peeling of the liquid repellant film 22 that is caused by contact of the blade section 201, deteriorations in the longevity of the blade section 201 and disruption of the nozzle plate 20.

In addition, in the abovementioned manner, as a result of the blade section 201 landing in the region B of the liquid ejecting surface 20*a* of the nozzle plate 20 and wiping the liquid ejecting surface 20*a* in the second direction Y thereafter after the blade section 201 has swept over the surface of the cover head 130, it is possible to suppress a circumstance in which the blade section 201 abuts against an end surface (a corner section or the like) of the nozzle plate 20. As a result of this configuration also, a circumstance in which the blade section 201 comes into contact with the end section of the nozzle plate 20 is suppressed, and therefore, it is possible to suppress peeling of the liquid repellant film 22 that is caused by contact of the blade section 201, deteriorations in the longevity of the blade section 201 and disruption of the nozzle plate 20.

Embodiment 2

Figure 13:
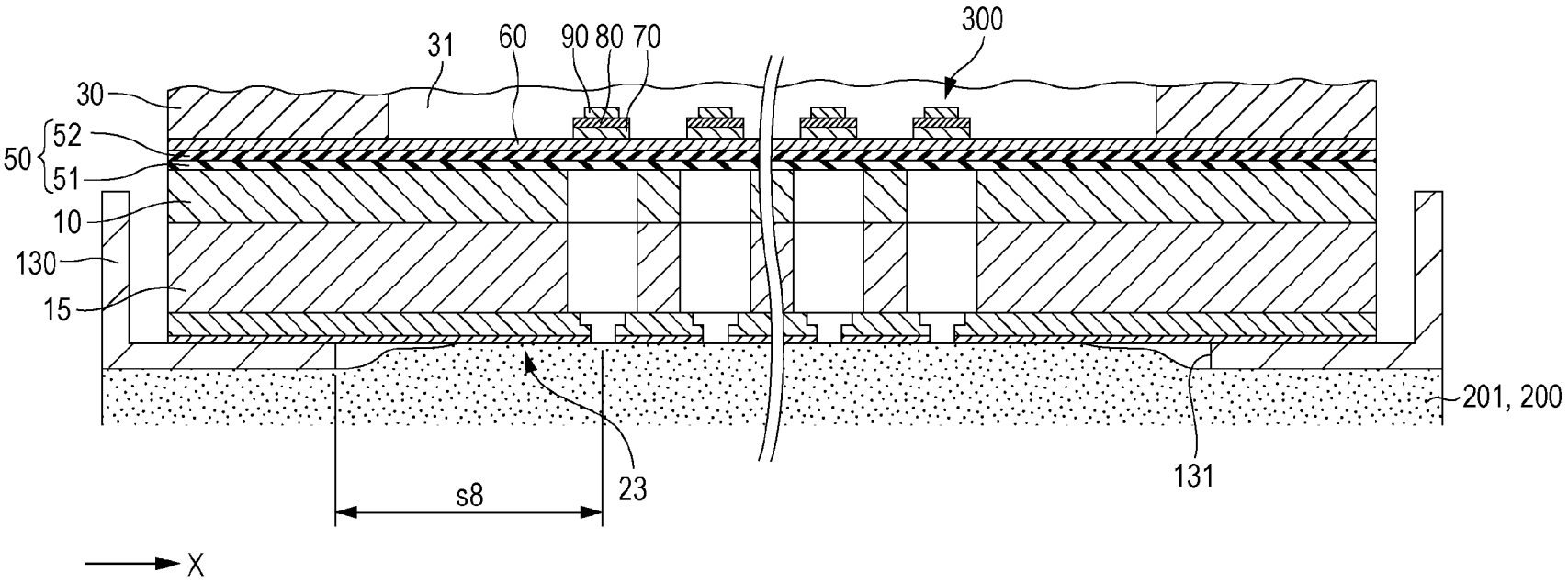
FIG. 13 is a cross-sectional view in which a main section of a recording head according to Embodiment 2 of the invention has been enlarged.

FIG. 13 is a cross-sectional view in which a main section of an ink jet type recording head, which is an example of a liquid ejecting head according to Embodiment 2 of the invention has been enlarged. Additionally, the same reference numerals are applied to members which are the same as in the abovementioned Embodiment 1, and overlapping descriptions thereof have been omitted.

As shown in FIG. 13, the nozzle plate 20 of the present embodiment is provided to extend to a region of the communication plate 15 in which the compliance substrate 45 is joined.

Even with this kind of configuration, as long as a distance s8 of the first blank space section 23 is set to a total distance of the distance s1 and the interval s3 of the abovementioned Embodiment 1, the deformation of the blade section 201 is stabilized, and therefore, it is possible to suppress a circumstance in which the end nozzle opening 21 remains unwiped by the blade section 201. In addition, since the end section of the nozzle plate 20 is not exposed inside the exposure opening section 131, the blade section 201 does not come into contact with the end section of the nozzle plate 20. Therefore, it is possible to suppress peeling of the liquid repellant film 22 that are caused by contact of the blade section 201, deteriorations in the longevity of the blade section 201 and disruption of the nozzle plate 20.

Additionally, the first blank space section 23 in the present embodiment is a region from the opening edge section of the exposure opening section 131 of the cover head 130 to the end nozzle opening 21, and a distance in the first direction X thereof is represented by s8.

Embodiment 3

Figure 14:
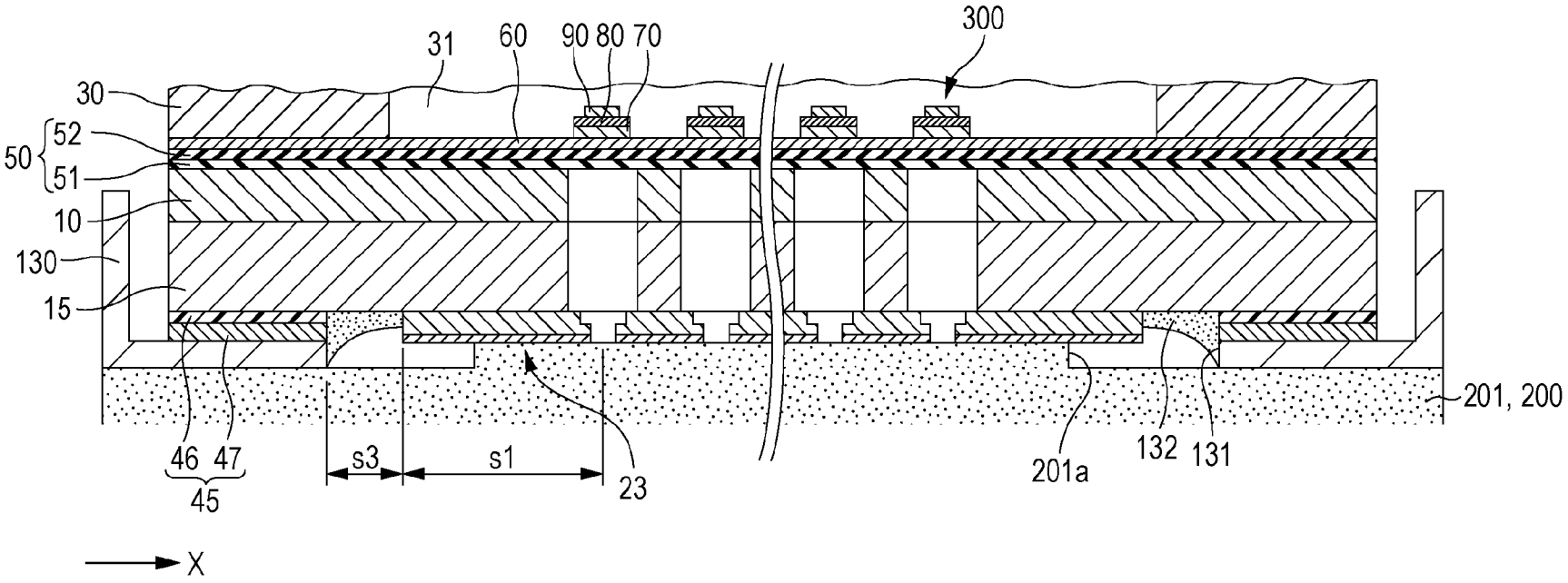
FIG. 14 is a cross-sectional view in which a main section of a recording head according to Embodiment 3 of the invention has been enlarged.

FIG. 14 is a cross-sectional view that shows the main sections of an ink jet type recording head, which is an example of a liquid ejecting head according to Embodiment 3 of the invention and the wiping section. Additionally, the same reference numerals are applied to members which are the same as in the abovementioned Embodiments, and overlapping descriptions thereof have been omitted.

As shown in FIG. 14, the blade section 201 of the wiping section 200 of the present embodiment has a convex portion 201*a* that protrudes toward the liquid ejecting surface 20*a* from the surface of the cover head 130.

Further, in addition to both sides of the convex portion 201*a* of the blade section 201 sweeping over the surface of the cover head 130, a leading end of the convex portion 201*a* sweeps over the liquid ejecting surface 20*a*.

Even with this kind of configuration, in the same manner as Embodiment 1 that is mentioned above, by making the distance s1 of the first blank space section 23 of the nozzle plate 20 longer than the distance s2 of the second blank space section 24, it is possible to reliably sweep over the entire nozzle opening 21 with the blade section 201. In addition, by defining an upper limit of the Step S3 of the cover head 130 and the end section of the nozzle plate 20 in addition to defining an upper limit of the distance s1 of the first blank space section 23, it is possible to suppress an increase in cost that results from an increase in the size of the nozzle plate 20.

Figure 15:
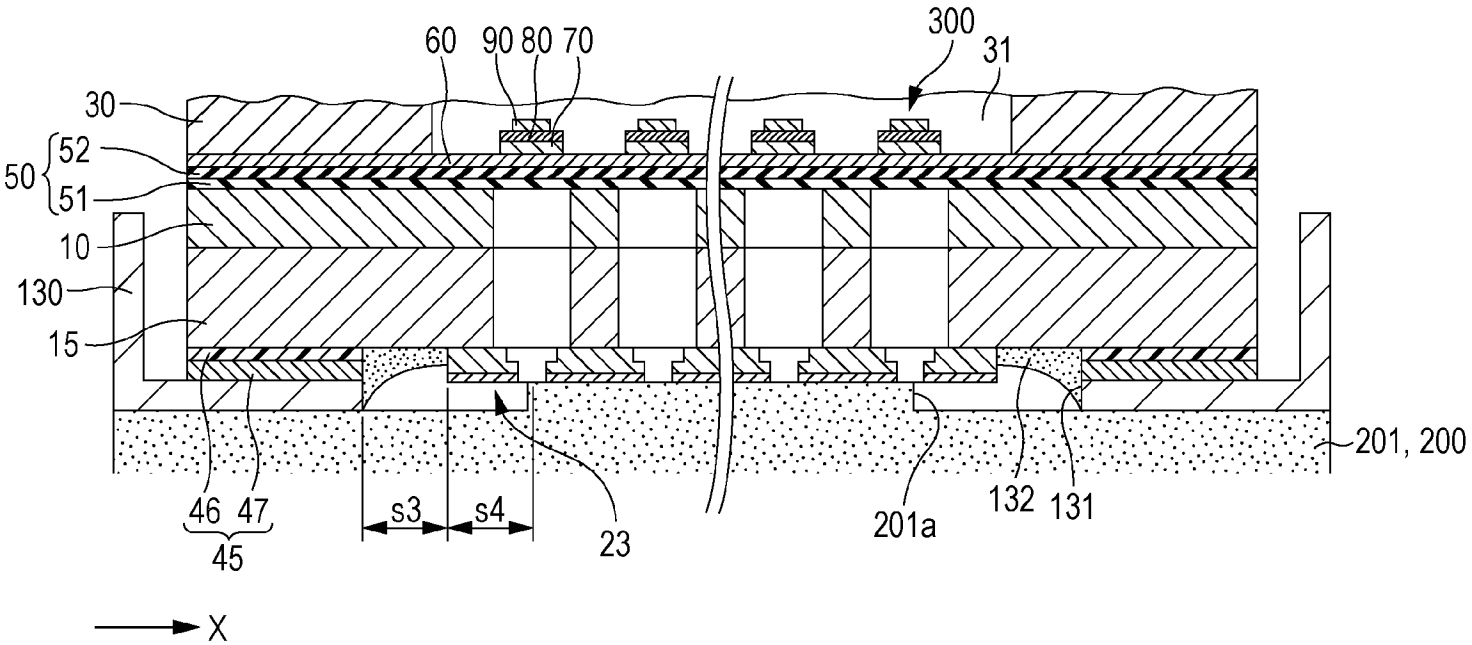
FIG. 15 is a cross-sectional view that shows a comparative example of the recording head according to Embodiment 3 of the invention.

In contrast to this, in a case in which, for example, as shown in FIG. 15, the first blank space section 23 is smaller than the distance s1, that is, setting to a distance s4 that is shorter than the distance s2, a distance s4+s3 between the cover head 130 and the end nozzle opening 21 becomes short. In this manner, if the distance between the cover head 130 and the cover head 130 and the end nozzle opening 21 is short, since the convex portion 201*a* is formed so as to not come into contact with the cover head 130 at a size that takes the extent of a given interval with an opening edge section of the exposure opening section 131 into account, there is a concern that it will not be possible to reliably sweep over the vicinity of the end nozzle opening 21 with the convex portion 201*a*, and therefore, that the end nozzle opening 21 will remain unwiped. In addition, even is the convex portion 201*a* of the blade section 201 is formed with a length that covers the entirety of nozzle openings 21, there is a tendency for the vicinity of the end nozzle opening to remain unwiped due to positional shift of the convex portion 201*a* of the blade section 201.

That is, in the present embodiment, by providing the convex portion 201*a* in the blade section 201, since there is a tendency for the blade section 201 to fall to the liquid ejecting surface 20*a* in a position that is sunk from the surface of the cover head 130, it is conceivable that it would be possible to made the distance s1 of the first blank space section 23 small, but since the convex portion 201*a* is formed so as to not come into contact with the cover head 130 at a size that takes the extent of a given interval with an opening edge section of the exposure opening section 131 into account, if the distance s1 of the first blank space section 23 is small, there is a concern that it will not be possible to reliably sweep over the vicinity of the end nozzle opening 21 with the convex portion 201*a*, and therefore, that the end nozzle opening 21 will remain unwiped. In addition, even if the convex portion 201*a* of the blade section 201 is formed with a length that covers the entirety of nozzle openings 21, there is a tendency for the vicinity of the end nozzle opening to remain unwiped due to positional shift of the convex portion 201*a*. Therefore, even in a case in which the convex portion 201*a* is provided in the blade section 201, it is necessary for the distance s1 of the first blank space section 23 to be comparatively large, that is, larger than the distance s2 of the first blank space section 23.

In addition, although not illustrated in the drawings, if the distance of the first blank space section 23 is made significantly larger than the distance s1, an increase in the size of the nozzle plate 20 is caused.

Figure 16:
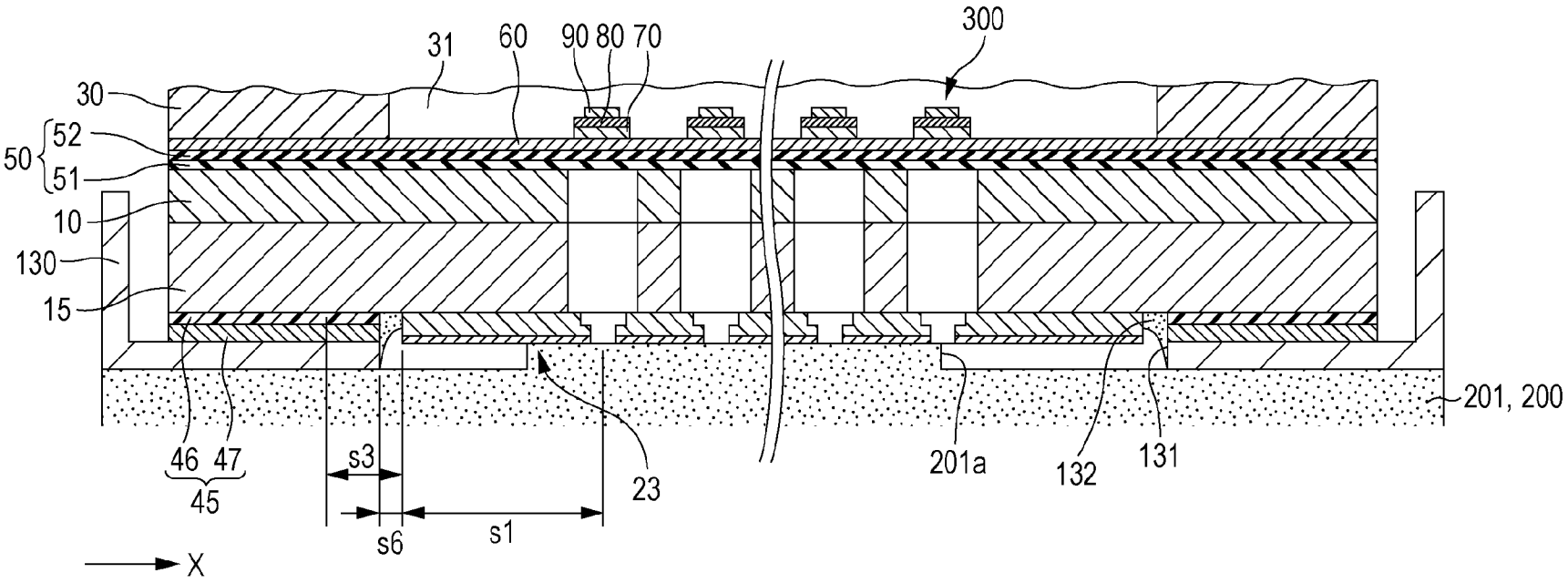
FIG. 16 is a cross-sectional view that shows a comparative example of the recording head according to Embodiment 3 of the invention.

In addition, as shown in FIG. 16, since the convex portion 201*a* of the blade section 201 is formed at a size at which the convex portion 201*a* does not come into contact with the cover head 130, in the same manner as a case in which the interval in the first direction X between the cover head 130 and the nozzle plate 20 is set to an interval s6 that is significantly smaller than the interval s3 is set, there is a concern that the vicinity of the end nozzle opening 21 will remain unwiped by the convex portion 201*a*. In addition, there is a concern that the vicinity of the end nozzle opening 21 to remain unwiped due to positional shift of the convex portion 201*a*. That is, even in a case in which the convex portion 201*a* is provided in the blade section 201, it is necessary for the distance s1 of the first blank space section 23 to be comparatively large, that is, larger than the distance s2 of the first blank space section 23.

Figure 17:
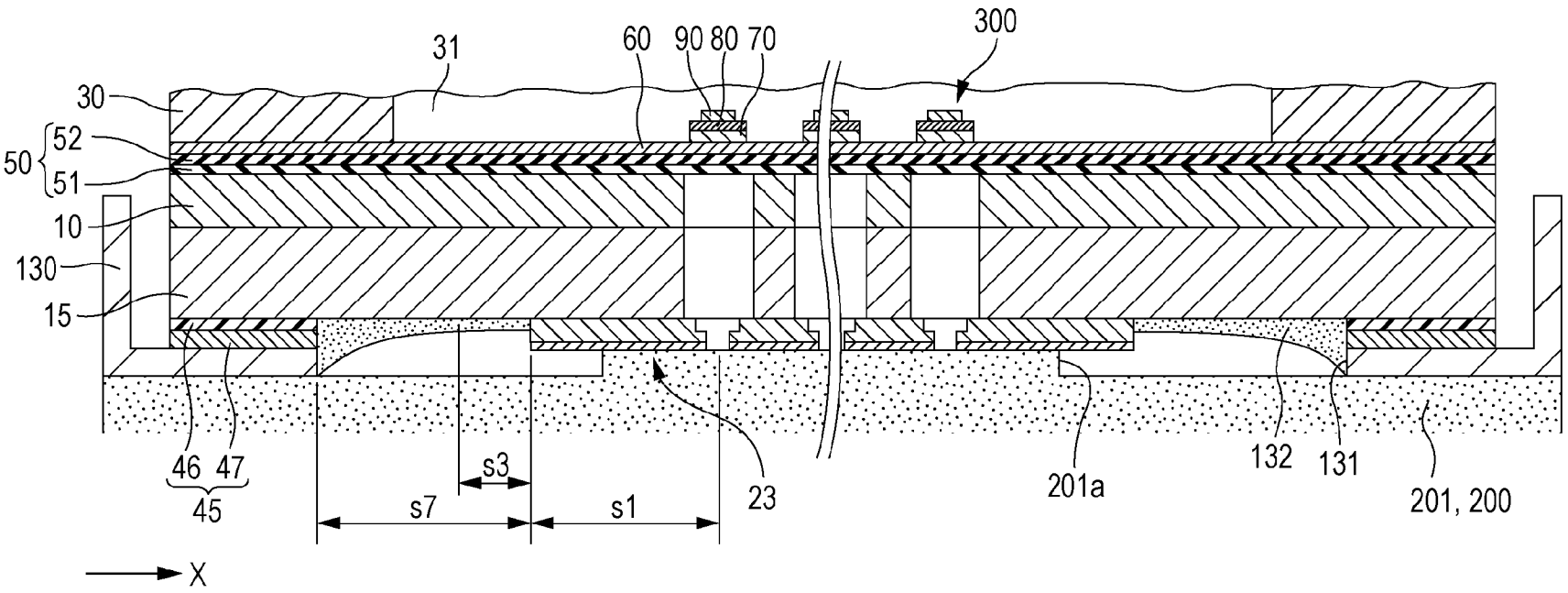
FIG. 17 is a cross-sectional view that shows a comparative example of the recording head according to Embodiment 3 of the invention.

Furthermore, as shown in FIG. 17, even if the interval between the cover head 130 and the nozzle plate 20 is set to an interval s7 that is significantly larger than the Step S3, since the interval between the cover head 130 and the nozzle plate 20 is filled with the filler 132, if a width in the first direction X of the convex portion 201*a* is large, there is a concern that the 201*a* will come into contact with the filler 132 and peeling of the filler 132 will be caused. Therefore, the convex portion 201*a* it is not possible to make the width of the first direction X large, and therefore, an increase in the size of the ink jet type recording head II is caused. In addition, even in a case in which the convex portion 201*a* is provided in the blade section 201, since positioning is necessary, the distance s1 of the first blank space section 23 is relatively large, that is, it is necessary to make the distance s1 larger than the distance s2 of the first blank space section 23.

In the present embodiment, by making the distance s1 of the first blank space section 23 of the nozzle plate 20 larger than the distance s2 of the second blank space section 24, it is also possible to reliably sweep over the liquid ejecting surface 20*a* with the blade section 201 that has the convex portion 201*a*. In addition, by making the distance s1 of the first blank space section 23 small, it is possible to suppress a circumstance in which the end nozzle opening 21 remains unwiped due to positional shift of the convex portion 201*a* of the blade section 201. In addition, by defining an upper limit and a lower limit of the distance s1 of the first blank space section 23, it is possible to achieve a reduction in the size of the nozzle plate 20 and a reduction in the size of the ink jet type recording head II.

Other Embodiments

Each embodiment of the invention is described above, but the basic configurations of the invention are not limited to those mentioned above.

For example, in each embodiment that is mentioned above, the cover head 130 was exemplified as the protective member, but configuration thereof is not particularly limited to this, and the protective member may be a component in which a plurality of members are laminated. In addition, the protective member is not limited to the cover head 130, and may be a flat plate-shaped plate member or the like.

In addition, in each embodiment that is mentioned above, a component that has the blade section 201, which is a plate member, and the base section 202 was exemplified as the wiping section 200, but the configuration thereof is not particularly limited to this, and for example, a configuration in which a porous material such as a sponge of a non-woven fabric sweeps across the liquid ejecting surface 20*a* can be used as the wiping section 200. That is, as long as, the wiping section 200 is a component that wipes the liquid ejecting surface 20*a* by sweeping over the liquid ejecting surface 20*a* and the like, the material and shape thereof are not limited.

In addition, in each embodiment that is mentioned above, the blade section 201 of the wiping section 200 was configured so as to sweep over the liquid ejecting surface 20*a* of the ink jet type recording head II by moving relatively in the second direction Y, but the configuration thereof is not particularly limited to this, and the wiping section 200 may be configured to sweep over on the liquid ejecting surface 20*a* while moving relatively in the first direction X. In this case, the distance s2 of the second blank space section 24 may be larger than the distance s1 of the first blank space section 23.

Furthermore, in each embodiment that is mentioned above, a single cover head 130 (exposure opening section 131) was provided with respect to a single head main body 11, but the configuration thereof is not particularly limited to this, and for example, a single cover head may be provided with respect to a plurality of two or more head main bodies 11. In this case, an exposure opening section 131 may be provided in the cover head for each head main body 11, or a configuration in which a plurality of head main bodies 11 are exposed by a single exposure opening section 131.

In addition, in the ink jet type recording apparatus I of Embodiment 1 that is mentioned above, a configuration in which the carriage 3 is equipped with the ink jet type recording head II (the head unit 1) that moves in the main scanning direction is used as an example, but the configuration thereof is not particularly limited to this, and for example, it is also possible to adopt a so-called line type recording apparatus in the invention in which the ink jet type recording head II is fixed, and which performs printing by moving recording sheets S such as paper in a sub scanning direction only.

In addition, in the abovementioned embodiments, an ink jet type recording apparatus that has an ink jet type recording head was described as an example of a liquid ejecting apparatus, but the invention is intended to be used generally in a wide range of liquid ejecting apparatuses, and naturally it is also possible to adopt the invention in a liquid ejecting apparatus that is provided with a liquid ejecting head that ejects a liquid other than ink. For example, it is possible to adopt the invention in various recording heads that are used in image recording apparatuses such as printers, color material ejecting heads that are used in the production of color filters such as liquid crystal displays, electrode material ejecting heads that are used in electrode formation such as organic EL displays, FEDs and the like, organic material ejecting heads that are used in the production of biochips and liquid ejecting apparatuses that are provided with these liquid ejecting heads.

What is claimed is:

1. A liquid ejecting apparatus comprising:

a liquid ejecting head that ejects a liquid from nozzle openings; and a wiping section that sweeps over a liquid ejecting surface side of the liquid ejecting head, wherein the liquid ejecting head is provided with a nozzle plate that has the liquid ejecting surface, and a protective member which has an opening section, and which is provided to protrude further on a side of the liquid ejecting surface than the nozzle plate, wherein a protrusion amount of the protective member from the liquid ejecting surface is greater than or equal to 30 μm but less than or equal to 100 μm, and which exposes the liquid ejecting surface, wherein the wiping section sweeps over the liquid ejecting surface of the nozzle plate by moving toward a sweeping direction, which is an in-plane direction of the liquid ejecting surface, wherein, in the nozzle plate, a distance in an orthogonal direction, which is orthogonal to the sweeping direction, of a first blank space section from an end of the nozzle plate to an end nozzle opening that is provided on a side of the end is greater than or equal to 0.8 mm but less than or equal to 3.0 mm and is longer than a distance in the sweeping direction of a second blank space section from an end of the nozzle plate to an end nozzle opening that is provided on a side of the end, and wherein an interval in the orthogonal direction between an opening edge section of the protective member and an end of the nozzle plate is greater than or equal to 0.05 mm but less than or equal to 0.3 mm.

2. The liquid ejecting apparatus according to claim 1, wherein a size of the first blank space section is greater than or equal to 1.0 mm but less than or equal to 2.0 mm.

3. The liquid ejecting apparatus according to claim 1, wherein the nozzle plate is smaller than an opening area of the opening section of the protective member.

4. The liquid ejecting apparatus according to claim 1, wherein the nozzle plate is formed from a silicon monocrystalline substrate.

5. A liquid ejecting apparatus comprising:

a liquid ejecting head that ejects a liquid from nozzle openings; and a wiping section that sweeps over a liquid ejecting surface side of the liquid ejecting head, wherein the liquid ejecting head is provided with a nozzle plate that has the liquid ejecting surface, and a protective member which has an opening section, and which is provided to protrude further on a side of the liquid ejecting surface than the nozzle plate, and which exposes the liquid ejecting surface, wherein the wiping section sweeps over the liquid ejecting surface of the nozzle plate by moving toward a sweeping direction, which is an in-plane direction of the liquid ejecting surface, wherein, in the nozzle plate, a distance in an orthogonal direction, which is orthogonal to the sweeping direction, of a first blank space section from an end of the nozzle plate to an end nozzle opening that is provided on a side of the end is longer than a distance in the sweeping direction of a second blank space section from an end of the nozzle plate to an end nozzle opening that is provided on a side of the end, and wherein the nozzle plate is smaller than an opening area of the opening section of the protective member.

6. The liquid ejecting apparatus according to claim 1, wherein a protrusion amount of the protective member from the liquid ejecting surface is greater than or equal to 30 μm but less than or equal to 100 μm, wherein an interval in the orthogonal direction between an opening edge section of the protective member and an end of the nozzle plate is greater than or equal to 0.05 mm but less than or equal to 0.3 mm, and wherein a distance of the first blank space section is greater than or equal to 0.8 mm but less than or equal to 3.0 mm.

7. The liquid ejecting apparatus according to claim 6, wherein a size of the first blank space section is greater than or equal to 1.0 mm but less than or equal to 2.0 mm.

8. The liquid ejecting apparatus according to claim 1, wherein the nozzle plate is formed from a silicon monocrystalline substrate.

* * * * *